US010099890B2

(12) United States Patent
Deckman et al.

(10) Patent No.: US 10,099,890 B2
(45) Date of Patent: Oct. 16, 2018

(54) DEVICES, SYSTEMS AND METHODS FOR KNOT TYING

(71) Applicant: Medicines360, San Francisco, CA (US)

(72) Inventors: Rob Deckman, San Bruno, CA (US); Ian Holland, Glasgow (GB); Matt Sellars, Warwick (GB); Nick Brooks, Wellesbourne (GB); Dave Phasey, Warwick (GB)

(73) Assignee: Medicines360, San Francisco, CA (US)

( * ) Notice: Subject to any disclaimer, the term of this patent is extended or adjusted under 35 U.S.C. 154(b) by 89 days.

(21) Appl. No.: 15/216,109

(22) Filed: Jul. 21, 2016

(65) Prior Publication Data

US 2017/0029236 A1 Feb. 2, 2017

Related U.S. Application Data

(60) Provisional application No. 62/200,051, filed on Aug. 2, 2015.

(51) Int. Cl.
*B65H 69/04* (2006.01)

(52) U.S. Cl.
CPC ..... *B65H 69/04* (2013.01)

(58) Field of Classification Search
CPC ..... B65H 69/04; A01K 91/04
See application file for complete search history.

(56) References Cited

U.S. PATENT DOCUMENTS 2,639,479 A * 5/1953 Dahm ..... B65D 63/14 24/16 R
2,873,133 A 2/1959 Wieser
3,490,801 A 1/1970 Feighery
3,877,737 A * 4/1975 Chappell ..... A01K 91/04 289/17
4,691,535 A * 9/1987 Cottenceau ..... B65H 69/04 289/3
4,836,587 A 6/1989 Hinzmann
4,870,772 A * 10/1989 Johns ..... A01K 97/26 289/17

(Continued)

FOREIGN PATENT DOCUMENTS

EP 2673230 B1 1/2015
WO 2012107464 A1 8/2012
WO 2017023573 A1 2/2017

OTHER PUBLICATIONS

International Search Report in PCT/US2016/043498 dated Oct. 12, 2016.

(Continued)

*Primary Examiner* — Shaun R Hurley
*Assistant Examiner* — Bao-Thieu L Nguyen
(74) *Attorney, Agent, or Firm* — Shartsis Friese, LLP; Cecily Anne O'Regan

(57) ABSTRACT

Disclosed is an apparatus or device for making knots in a flexible element that engages a medical device, such as an IUD, and associated methods. The knot tying device receives the medical device in a loading element, and then threads the flexible member through an aperture of the medical device using a spooling element. A looping element and knotting element ties the flexible member into a knot. The devices, systems and methods can create a double loop surgeon's knot that are reproducible during the manufacturing process.

18 Claims, 28 Drawing Sheets

(56) References Cited

U.S. PATENT DOCUMENTS 5,217,470 A * 6/1993 Weston ..... A61B 17/0469 289/1.2
5,240,295 A 8/1993 Spencer
5,566,435 A 10/1996 Brown
5,846,254 A * 12/1998 Schulze ..... A61B 17/0469 289/1.2
5,873,216 A * 2/1999 Appelbe ..... B31D 1/023 493/375
5,947,166 A * 9/1999 Doyle ..... E04G 21/122 140/119
641,928 A1 7/2002 Thomas et al.
6,419,283 B1 * 7/2002 Thomas ..... B65H 65/005 289/1.2
6,616,198 B2 * 9/2003 Kitazawa ..... B65H 69/00 289/1.2
6,641,181 B2 * 11/2003 Thomas ..... B65H 65/005 289/1.2
6,648,378 B1 * 11/2003 Torres ..... B65B 13/025 289/1.2
6,746,699 B2 * 6/2004 Lohrey ..... B65B 29/04 289/1.5
6,817,634 B2 * 11/2004 Champion ..... A01K 91/04 289/1.5
7,264,282 B2 * 9/2007 Lambertz ..... B65B 29/04 289/1.5
7,419,195 B1 * 9/2008 Jochum ..... D03J 3/00 289/17
8,007,281 B2 * 8/2011 Toly ..... A61B 90/36 434/262
8,414,035 B2 4/2013 Bell
8,491,018 B2 * 7/2013 Borrowman ..... B65B 51/08 289/2
8,511,722 B1 8/2013 Farner et al.
8,573,656 B1 11/2013 Zhang et al.
8,936,282 B1 1/2015 Berdahl
8,985,642 B2 * 3/2015 Romagnoli ..... B65B 29/04 289/1.5
9,084,414 B1 * 7/2015 Fender ..... A01K 91/04
9,260,271 B1 * 2/2016 Bowman, Jr. ..... A01K 91/04
9,730,793 B2 * 8/2017 Reich ..... A61F 2/2427
2007/0203508 A1 8/2007 White et al.
2011/0106245 A1 * 5/2011 Miller ..... A61F 2/2442 623/2.11
2012/0326442 A1 * 12/2012 Crichton ..... B65B 13/26 289/2
2013/0298361 A1 11/2013 Pasteels
2014/0167413 A1 * 6/2014 Ross ..... A01K 91/04 289/1.5
2017/0022606 A1 * 1/2017 Nakada ..... C23C 14/562

OTHER PUBLICATIONS

Rivera et al., "The Intrauterine Device in the Present and Future", Dec. 1993, Curr. Opinion Obstet. Gynecol. 5 (6):829-32 [Abstract].
Roberts et al., "Scanning electron microscopy of the multifilament IUD strong", Mar. 1984, Contraception 29:215-228 [Abstract].

* cited by examiner

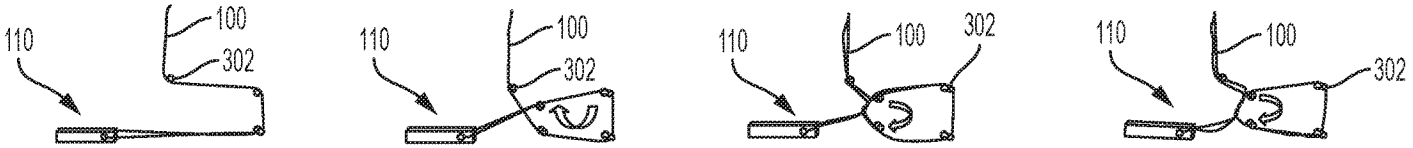
FIG. 3A
PRIOR ART
FIG. 3B
PRIOR ART
FIG. 3C
PRIOR ART
FIG. 3D
PRIOR ART
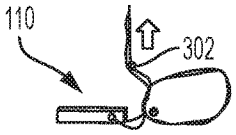
FIG. 3E
PRIOR ART
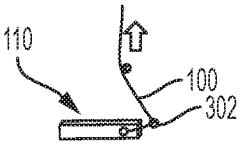
FIG. 3F
PRIOR ART
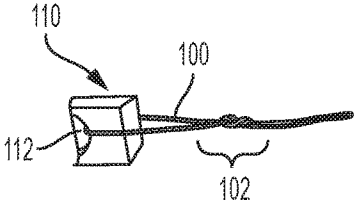
FIG. 3G
PRIOR ART
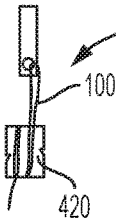
FIG. 4A
PRIOR ART
FIG. 4B
PRIOR ART
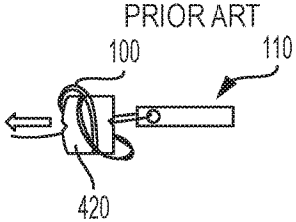
FIG. 4C
PRIOR ART
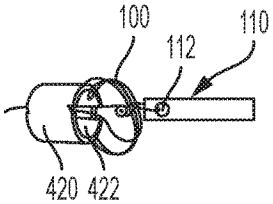
FIG. 4D
PRIOR ART
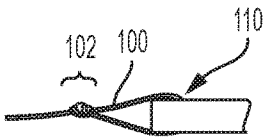
FIG. 4E
PRIOR ART
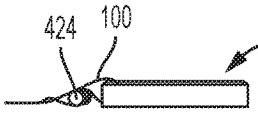
FIG. 4F
PRIOR ART
FIG. 4G
PRIOR ART

DEVICES, SYSTEMS AND METHODS FOR KNOT TYING

CROSS-REFERENCE

This application claims the benefit of U.S. Provisional Application No. 62/200,051, filed Aug. 2, 2015, entitled Devices, Systems and Methods for Knot Tying which application is incorporated herein by reference.

BACKGROUND

Knot tying generally requires inserting one end of a wire or string through a loop formed in the wire to create a knot. Handling of the wire or string during the knotting process can be relatively complex—particularly when the wire or string has a small diameter. Automated knot tying apparatuses have used robotic means where the wire or string being knotted is held and released at different points during the knotting process.

As is known in the art, a surgeon's knot is a simple modification of a reef knot. The surgeon's knot adds an extra twist when tying the first throw, which results in forming a double overhand knot. In practice, the additional turn provides more friction and can reduce loosening while the second half of the knot is tied. This additional integrity to the knot is an important feature in the surgical setting. This knot is commonly used by surgeons in situations where it is important to maintain tension on a suture.

Devices such as hormonal or copper intrauterine devices (IUD), which are used as a common method of anti-conception and/or for treatment of menorrhagia, have a string attached to the device. After insertion of a T-shaped IUD, the string remains positioned within the cervix for a period of 3 to 10 years to facilitate extraction of the IUD by the health care provider. It is customary to provide the string of an IUD with a knot to securely fasten the string. However, to facilitate delivery via an inserter and optimal positioning within the patient's cervix, the knot should be tied so that the knot is not too close or too far from the IUD or does not have a profile exceeding an optimal height. The position of the knot with respect to the IUD and its form and thickness is also important to ensure compatibility with the IUD insertion device and to avoid spreading of possible infectious agents such as viruses, bacteria and fungi from the vaginal region into the uterus, since it has been observed that said knot can be the thriving place of infectious agents. See, for example, Roberts at al., 1984, Contraception 29, Issue 3, pp 215-228; Rivera at al., 1993, Curr. Opin. Obstet. Gynecol. 5(6):829-32). What are needed are devices and methods that facilitate reproducible knotting results.

SUMMARY

Disclosed are devices and methods for creating a double loop surgeon's knot.

An aspect of the disclosure is directed to an apparatus for forming a knot in a flexible element which has been threaded through an aperture of a medical device. Suitable apparatuses comprise: a loading element for receiving the medical device; a spooling element for threading the flexible member through the aperture of the medical device wherein the spooling element automatically engages the loading element; a looping element for looping the flexible member wherein the looping element automatically engages when the flexible member is threaded through the aperture of the medical device; a knot tightening element for tightening the looped flexible member to form the knot wherein the knot tightening element automatically engages after the looping element loops the flexible member; and a base wherein the loading element, spooling element and looping element are positioned on an upper surface of the base. Additionally, in some configurations, the loading element further comprises a platform for engaging the medical device wherein the platform for engaging the medical device integrally forms with a barrel having a central barrel aperture. The looping element can further comprise a winding mandrel. In some configurations, the knot tightening element can further comprise a rotary lock and a shaft. Additionally, the spooling element can further comprise a spool spindle, a nip feed and a thread spool. A housing can be provided wherein the loading element, spooling element, looping element, knot tying element and base are positioned within the housing. Additionally, the apparatus can engage a vision inspection device. The vision inspection device can be used to inspect the quality of the knot prior to releasing device for packaging. Suitable vision inspection devices include a camera and a device holder.

Another aspect of the disclosure is directed to an apparatus for forming a knot in a flexible element which has been threaded through an aperture of a medical device. Suitable apparatuses comprise: a loading element for receiving the medical device; a spooling element for threading the flexible member through the aperture of the medical device wherein the spooling element automatically or semi-automatically engages the loading element; a looping element for looping the flexible member wherein the looping element automatically or semi-automatically engages when the flexible member is threaded through the aperture of the medical device; a knot tightening element for tightening the looped flexible member to form the knot wherein the knot tightening element automatically or semi-automatically engages after the looping element loops the flexible member; and a base wherein the loading element, spooling element and looping element are positioned on an upper surface of the base. Additionally, in some configurations, the loading element further comprises a platform for engaging the medical device wherein the platform for engaging the medical device integrally forms with a barrel having a central barrel aperture. The looping element can further comprise a winding mandrel. In some configurations, the knot tightening element can further comprise a rotary lock and a shaft. Additionally, the spooling element can further comprise a spool spindle, a nip feed and a thread spool. A housing can be provided wherein the loading element, spooling element, looping element, knot tying element and base are positioned within the housing. Additionally, the apparatus can engage a vision inspection device. The vision inspection device can be used to inspect the quality of the knot prior to releasing device for packaging. Suitable vision inspection devices include a camera and a device holder.

Yet another aspect of the disclosure is directed to a method of forming a knot in a medical device. Suitable methods comprise: loading the medical device into a knotting device; passing a flexible element through an aperture in the medical device; winding a length of the flexible element about a spindle of the knotting device; releasing a first end and a second end of a flexible element; moving a first knotting component away from a second knotting component; engaging a portion of the wound flexible element with a hook; applying a tension on the flexible element; and releasing the hook as the knot forms adjacent the medical device, wherein the method is performed automatically or semi-automatically. The method of forming the knot in a medical device can further include obtaining an image of the formed knot. The image can then be analyzed to determine a dimension and a location of the knot relative to the body of the medical device. Additional steps can include processing the device with the flexible member into an approved container if the analyzed dimensions are within a dimensional range.

Still another aspect of the disclosure is directed to an apparatus for forming a knot in a flexible element which has been threaded through an aperture of a medical device comprising: a loading element means for receiving the medical device; a spooling element means for threading the flexible member through the aperture of the medical device wherein the spooling element means automatically engages the loading element means; a looping element means for looping the flexible member wherein the looping element means automatically engages when the flexible member is threaded through the aperture of the medical device; a knot tightening element means for tightening the looped flexible member to form the knot wherein the knot tightening element automatically engages after the looping element means loops the flexible member; and a base wherein the loading element means, spooling element means and looping element means are positioned on an upper surface of the base. The loading element means can further comprises a platform for engaging the medical device wherein the platform for engaging the medical device integrally forms with a barrel having a central barrel aperture. Additionally, the looping element means further comprises a winding mandrel. In some configurations the knot tightening element means further comprises a rotary lock and a shaft, while the spooling element means can further comprise a spool spindle, a nip feed and a thread spool. The entire apparatus or device can be positioned within a housing enclosing all or a part of the loading element means, spooling element means, looping element means, knot tying element means and base. Additionally, the apparatus can be connected to a vision inspection device means. The vision inspection device means can include, for example, a camera and a device holder.

Yet another aspect of the disclosure is directed to an apparatus for forming a knot in a flexible element which has been threaded through an aperture of a medical device comprising: a loading element means for receiving the medical device; a spooling element means for threading the flexible member through the aperture of the medical device wherein the spooling element means automatically or semi-automatically engages the loading element means; a looping element means for looping the flexible member wherein the looping element means automatically or semi-automatically engages when the flexible member is threaded through the aperture of the medical device; a knot tightening element means for tightening the looped flexible member to form the knot wherein the knot tightening element automatically or semi-automatically engages after the looping element means loops the flexible member; and a base wherein the loading element means, spooling element means and looping element means are positioned on an upper surface of the base. The loading element means can further comprises a platform for engaging the medical device wherein the platform for engaging the medical device integrally forms with a barrel having a central barrel aperture. Additionally, the looping element means further comprises a winding mandrel. In some configurations the knot tightening element means further comprises a rotary lock and a shaft, while the spooling element means can further comprise a spool spindle, a nip feed and a thread spool. The entire apparatus or device can be positioned within a housing enclosing all or a part of the loading element means, spooling element means, looping element means, knot tying element means and base. Additionally, the apparatus can be connected to a vision inspection device means. The vision inspection device means can include, for example, a camera and a device holder.

INCORPORATION BY REFERENCE

All publications, patents, and patent applications mentioned in this specification are herein incorporated by reference to the same extent as if each individual publication, patent, or patent application was specifically and individually indicated to be incorporated by reference. Disclosures related to knot tying devices include, for example, U.S. Pat. No. 8,936,282 B1 issued Jan. 20, 2015 to Berdahl for Stop Knot Tying Device; U.S. Pat. No. 8,573,656 B1 issued Nov. 5, 2013, to Zhang for Knot-Tying Device and Method; U.S. Pat. No. 8,511,722 B1 issued Aug. 20, 2013, to Farner for Knot Tying Device; U.S. Pat. No. 8,414,035 B2 issued Apr. 9, 2013, to Bell for System and Method for Providing Knot Tying; U.S. Pat. No. 6,641,181 B2 issued Nov. 4, 2003, to Thomas for Automatic Knot-Tying Machine; U.S. Pat. No. 6,419,283 B1 issued Jul. 16, 2002 to Thomas for Automatic Knot-Tying Machine; U.S. Pat. No. 5,566,435 A issued Oct. 22, 1996 to Brown Jr. for Method of attaching a tampon withdrawal cord with an overhand hitch knot; U.S. Pat. No. 4,836,587 A issued Jun. 6, 1989, to Hinzmann for Apparatus for Making Knots in Drawstrings of Catamenial Tampons; U.S. Pat. No. 3,490,801 A issued Jan. 20, 1970 for Knot Tying Device for Fringes; U.S. Pat. No. 2,873,133 A issued Feb. 10, 1959 to Wieser for Device for Tying a Thread Round an Object and for Knotting the Thread Ends; US2013/0298361 A1 published Nov. 14, 2013, to Pasteels for Apparatus for Knotting Drawstrings of Medical Devices or Medical Devices Containing Drugs; US 2007/0203508 A1 published Aug. 30, 2007, to White et al. for Bone Anchor Suture-Loading System, Method and Apparatus; WO 2012/107464 A1 published Aug. 16, 2012, to Pasteels for Apparatus for Knotting Drawstrings of Medical Devices or Medical Devices Containing Drugs.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIGS. 3A-G illustrate a process of forming a surgeon's knot through an eyelet of an IUD;

FIGS. 4A-G illustrate another method of forming a surgeon's knot;

FIGS. 8A-1, 8A-2, 8B-1, and 8B-2 illustrate a device for forming a surgeon's knot.

FIGS. 9A-1, 9A-2, 9B-9C, 9D-1, 9-D2, and 9E-9J illustrate a device for forming a surgeon's knot;

DETAILED DESCRIPTION

Figure 1A:
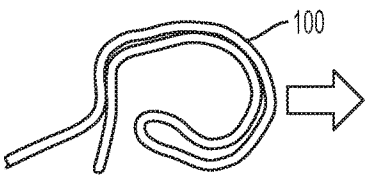
FIG. 1A PRIOR ART
FIGS. 1A-G illustrates the process of forming a surgeon's knot.
Figure 1B:
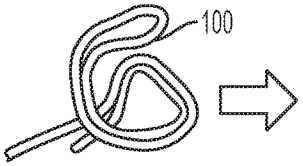
FIG. 1B PRIOR ART
Figure 1C:
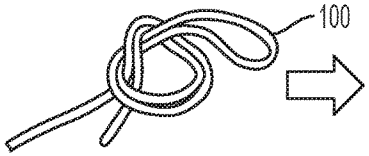
FIG. 1C PRIOR ART
Figure 1D:
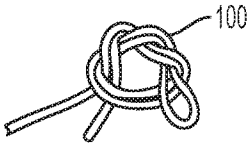
FIG. 1D PRIOR ART
Figure 1E:
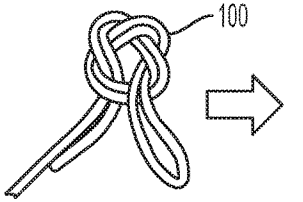
FIG. 1E PRIOR ART
Figure 1F:
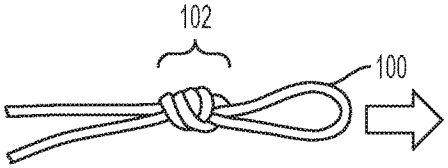
FIG. 1F PRIOR ART
Figure 1G:
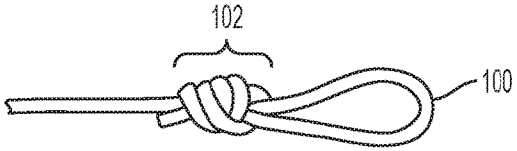
FIG. 1G PRIOR ART

FIGS. 1A-G illustrates the process of forming a surgeon's knot 102. A flexible element 100 such as a thread, a wire, a suture or a string is formed in a "u" shape as shown in FIG. 1A. The u-shape is then flipped to form a loop where the thread crosses over itself as shown in FIG. 1B. An end is then passed through the loop as shown in FIG. 1C; and then passed through the loop again as shown in FIG. 1D. As shown in FIGS. 1E-1G, when the ends are pulled, a loop is formed with a double secure knot.

Figure 2:
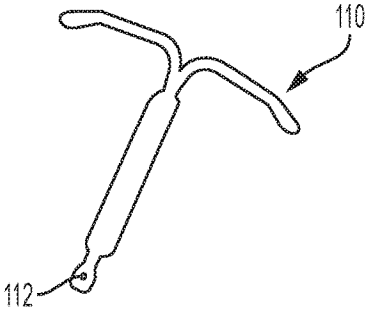
FIG. 2 PRIOR ART
FIG. 2 illustrates an intrauterine device (IUD)

FIG. 2 illustrates a medical device 110 having an eyelet (aperture) 112 at one end through which a flexible element such as a string passes, such as a t-frame intrauterine device.

FIGS. 3A-G illustrate a method of forming a surgeon's knot 102 on the end of a medical device 110 having an eyelet 112, such as an intrauterine device (IUD). The flexible element 100 is formed in a "u" shape with the string passed through and eyelet 112 in the medical device 110, and the open end of the flexible element 100 and the medical device 110 held as shown in FIG. 3A. One or more pins 302 are used to facilitate the positioning of flexible element 100 relative to the device during the knot tying process. The u-shape of the flexible element 100 is then flipped to form a loop where the flexible element 100 crosses over itself as shown in FIG. 3B. The IUD is then passed through the loop formed by the flexible element 100 as shown in FIG. 3C; and then passed through the loop again as shown in FIG. 3D. The pins holding the loop of the flexible element 100 open are removed and one pin 302 is placed next to the IUD inside the loop as shown in FIG. 3E. The flexible element 100 is then pulled tight to form a knot around the pin next to the IUD as shown in FIG. 3F. Finally, the pin is removed as the knot becomes small to leave a finished knot which is positioned close to the IUD as shown in FIG. 3G.

FIGS. 4A-G illustrate another method of forming a surgeon's knot 102 on the end of a medical device 110 having an eyelet 112, such as an IUD. As shown in FIG. 4A, the flexible element 100 is passed through an aperture or eyelet 112 in the medical device 110, and the two ends of the flexible element 100 are wound around a barrel 420. The medical device 110 is then passed through a barrel aperture 422 crossing over the open threaded end as shown in FIG. 4B. Once the medical device 110 is passed through the barrel aperture 422, the medical device 110 is passed over the flexible element 100 as shown in FIG. 4C. The surgeon's knot 102 is then slid off of the barrel 420 as shown in FIG. 4D. A pin 424 is then placed in the surgeon's knot 102 close to the medical device 110 as shown in FIG. 3E, thereafter the surgeon's knot 102 is tightened against the pin 424 as shown in FIG. 4F. The pin 424 is then removed and the surgeon's knot 102 is tightened further as shown in FIG. 4G. The result is that once tightened the surgeon's knot 102 of the flexible element 100 is positioned a target distance from the eyelet 112 of the medical device 110.

Figure 5A:
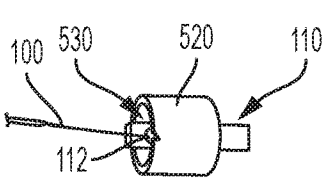
FIGS. 5A-G illustrate a device for forming a surgeon's knot.
Figure 5B:
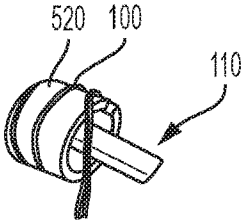
Figure 5C:
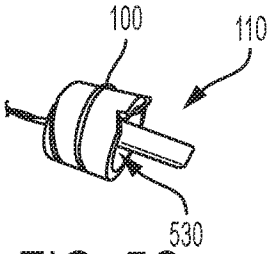
Figure 5D:
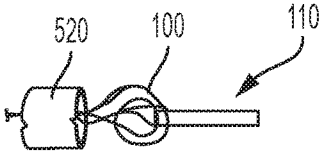
Figure 5E:
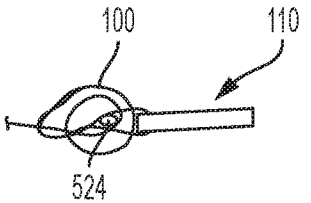
Figure 5F:
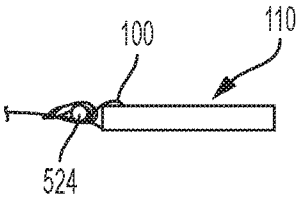
Figure 5G:
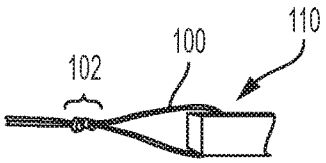

FIGS. 5A-G illustrate another device for forming a surgeon's knot 102. An eyelet 112 containing medical device 110, such as an IUD, with a flexible element 100 passed through the eyelet 112 is placed into a barrel 520 having a central barrel aperture 530 as shown in FIG. 5A. Thereafter the flexible element 100 is wound two times around the barrel 520 as shown in FIG. 5B. The flexible element 100 is pulled through the central barrel aperture 530 as shown in FIG. 5C. As shown in FIG. 5D, the surgeon's knot 102 is then formed as the flexible element 100 is detached from the barrel. A pin 524 is placed in the surgeon's knot 102 close to the medical device 110 as shown in FIG. 5F. The pin 524 is then removed and flexible element 100 is tightened as shown in FIG. 5G. This method facilitates forming a surgeon's knot 102 at a target distance from the end of the eyelet 112 of the medical device 110—instead of adjacent the medical device 110. Another process of forming a surgeon's knot using the components from FIG. 5, includes forming a complete loop of a flexible element 100 that is passed through an eyelet 112 of a medical device 110, such as an IUD. The medical device 110 and flexible element 100 is wound around a barrel 520 twice and then the medical device 110 is passed through the central barrel aperture 530 leaving two winds of flexible element 100 around the exterior of the barrel 520 with an end of the flexible element 100 passing through the central barrel aperture 530 to the eyelet 112 of the medical device 110. Once the medical device 110 is passed through the central barrel aperture 530, the flexible element 100 positioned around the barrel 520 are slid off the barrel 520. A pin 524 is placed through the winds of the flexible element 100 which were slid off of the barrel 520 at a position near the eyelet 112. Tension is placed on the flexible element 100 to begin tightening the surgeon's knot 102 of the flexible element 100 against the pin 524. As the surgeon's knot 102 nears completion, but before the tension around the pin 524 is too great, the pin 524 is removed, and then the final tension is applied to the flexible element 100 to form the surgeon's knot 102.

Figure 6A:
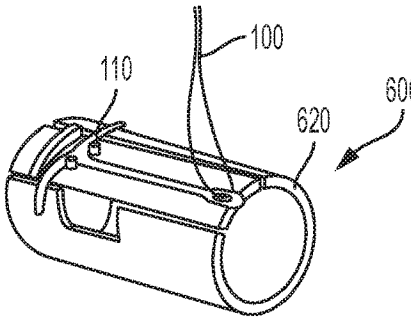
FIGS. 6A-C illustrate a barrel suitable for forming a surgeon's knot.
Figure 6B:
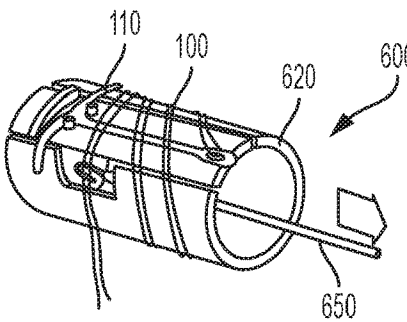
Figure 6C:
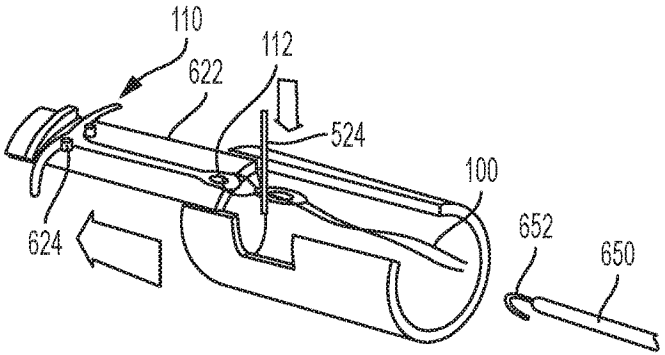
Figures 1, 8A:
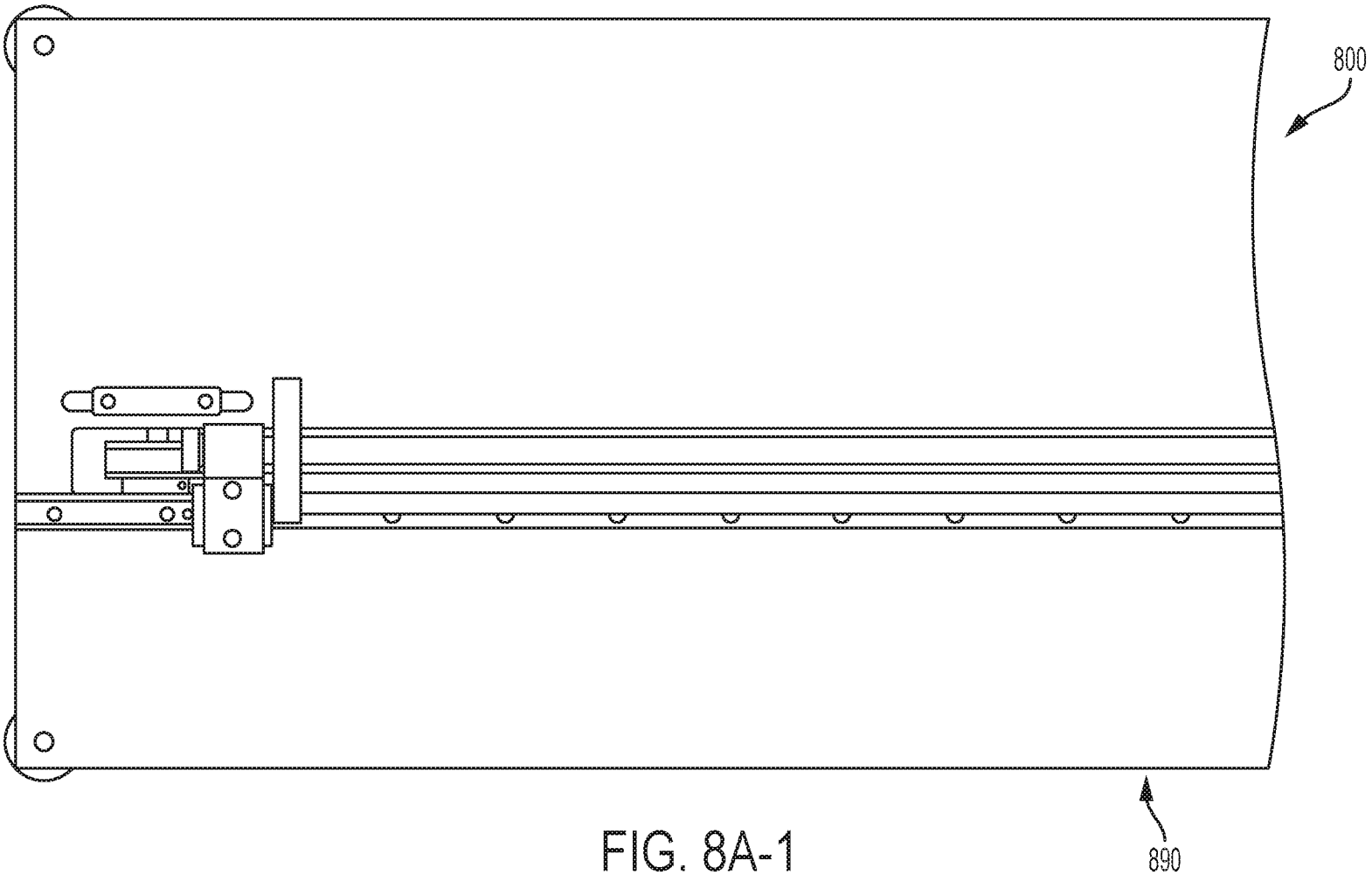
Figures 2, 8A:
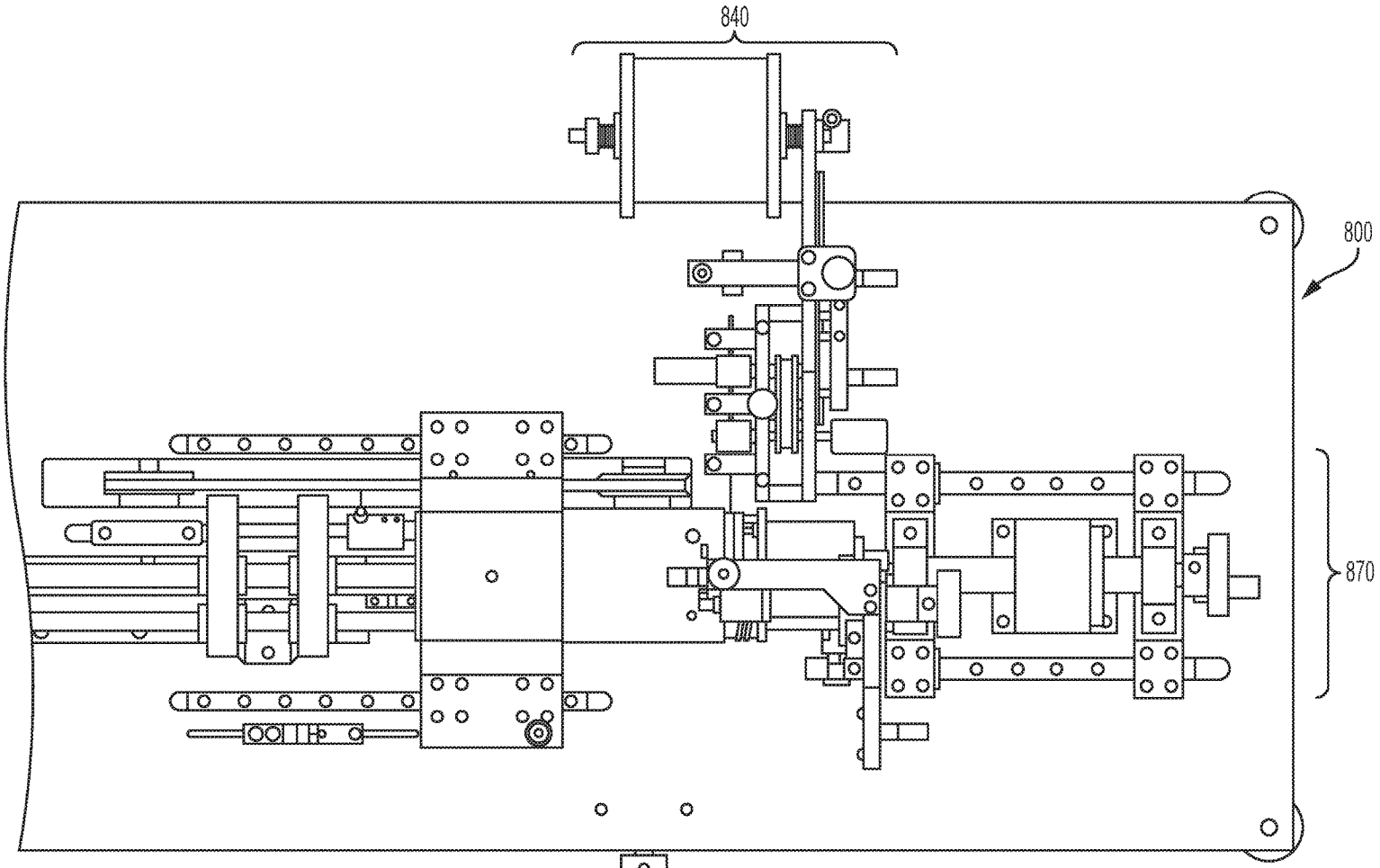
Figures 1, 8B:
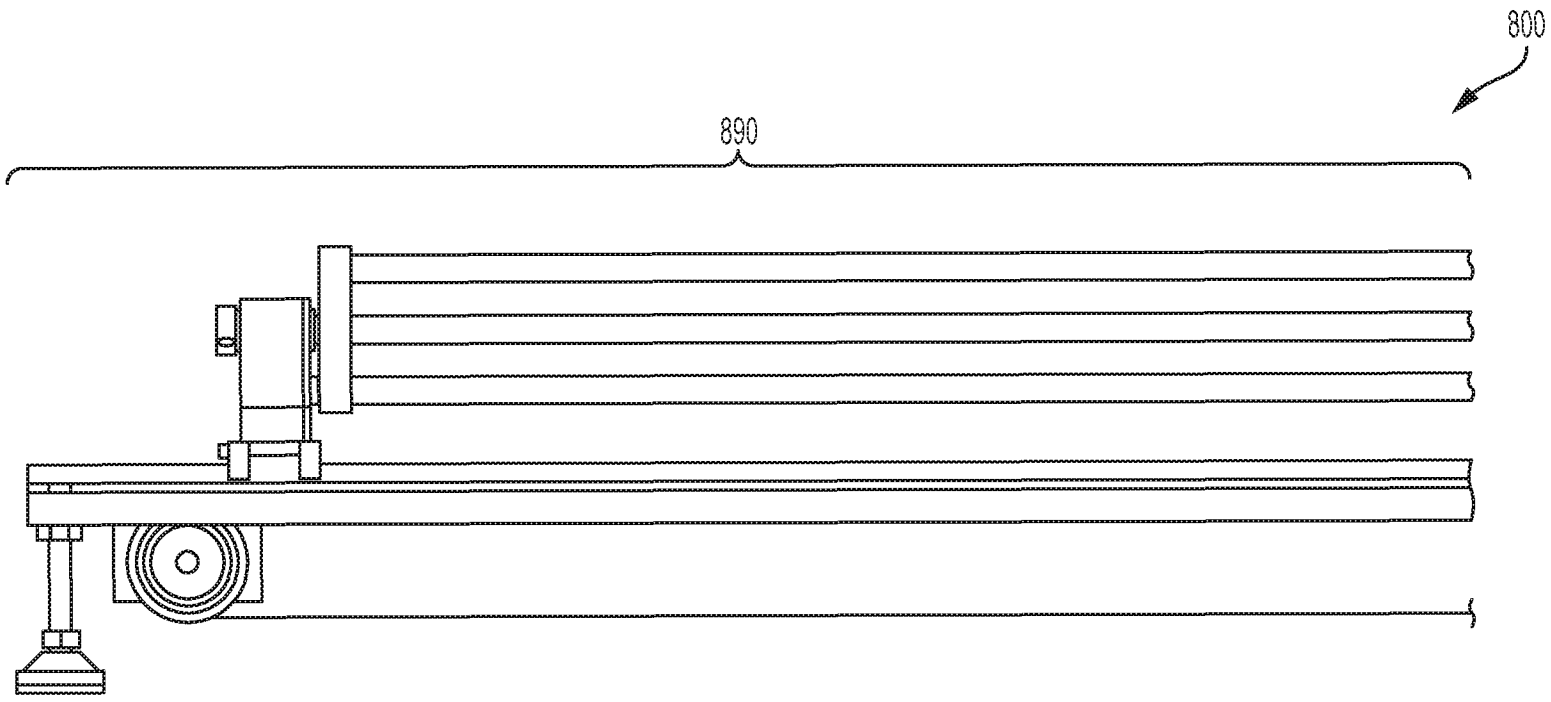
Figures 2, 8B:
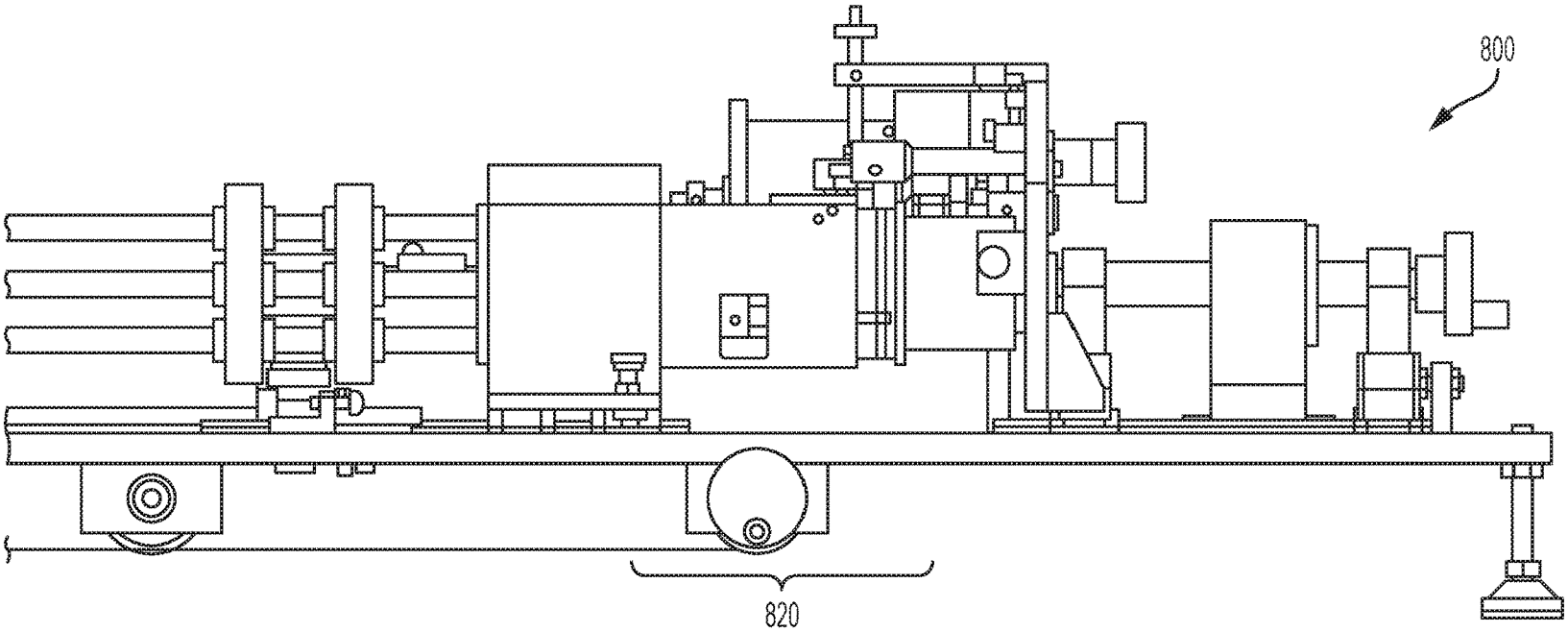

FIGS. 6A-C illustrate a device retainer 600 which includes a barrel 620 having a device holder 622 configured to hold an eyelet 112 containing device such as a medical device 110. The barrel 620 contains a device holder 622 which can be removable and can have one or more pins 624 positioned to orient the medical device 110 on the device holder 622. The medical device 110 is secured within the device holder 622 on an exterior surface of the device holder 622. Once the medical device 110 is constrained, the flexible element 100, which has been fed through the eyelet 112 of the medical device 110, is wound around the barrel arrangement, i.e., the combination of the barrel 620 and the device holder 622, until 2 full turns of the flexible element 100 around the exterior of the barrel arrangement are formed. The open ends of the flexible element 100 are then grabbed by the hook 652 of the knotting tool 650 and the flexible element 100 is pulled through the device holder 622. The device, such as the medical device 110, is then pulled away from the device holder 622 and a pin 524 can be inserted to tighten the surgeon's knot 102 against. The barrel 620 can be used as part of a larger system as shown in FIGS. 8A-1-8F at 800.

Figure 7A:
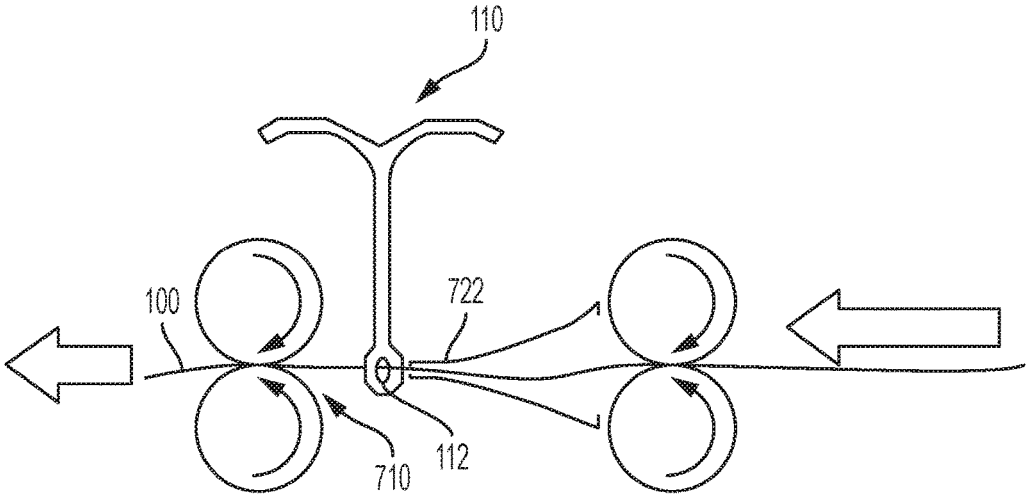
FIGS. 7A-B illustrate a system for getting a suture or thread through an eyelet in an IUD.
Figure 7B:
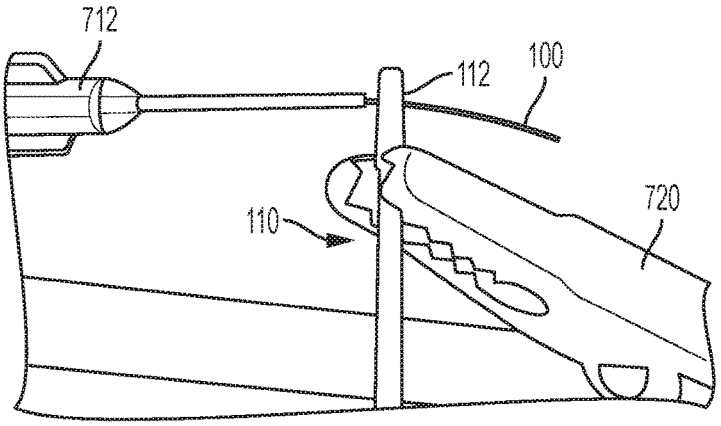

FIGS. 7A-B illustrate a system for forming a surgeon's knot using a grasper 720 and a threader 722 to put a flexible element 100 through an eyelet 112 in the aperture containing medical device 110. The flexible element 100 can be fed through a nip feeder 710.

FIGS. 8A-1-8B-2 illustrate a knot tying device 800 for forming a surgeon's knot from a top view and a side view. The knot tying device 800 has several functional components: a device loader which includes a device retainer 600 (shown in FIG. 6), a threader/spooler, a loop formation component, and a knot tightening apparatus. A device removal component can also be provided. The functional components or apparatus are located on the device in a device loader area 820 which includes a device retainer 600 (shown in FIG. 6), a threader/spooler area 840, a loop formation component area 870, and a knot tightening apparatus area 890.

Figure 8C:
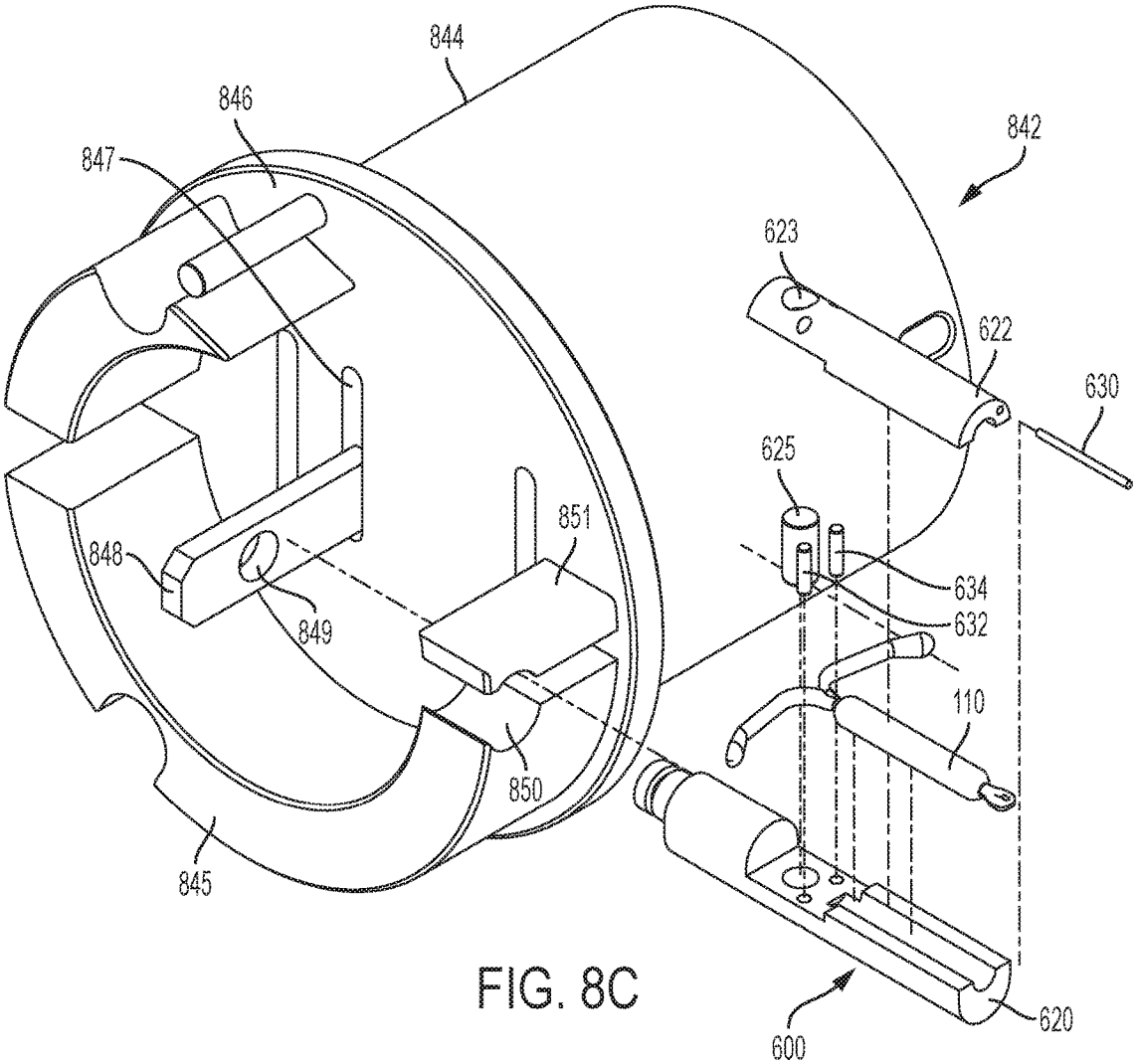
FIG. 8C is an exploded view of a winding mandrel.

FIG. 8C is an exploded view of a winding mandrel 842 which is part of the threader/spooler area 840 shown in FIGS. 8A-1-8B-2. The winding mandrel 842 is a shaft or cylindrical rod which can be turned. The winding mandrel 842 has a knotting spindle 844 with a face 846. A locking tab 848 with a locking tab aperture 849 extends through a face aperture 847 of the face 846 that is perpendicular to the walls of the knotting spindle 844. The shaft is substantially cylindrical. A flange 845 extends from the planar surface of the face 846. The flange 845 can be configured such that it extends from the face around a portion of the perimeter and is shaped similarly to the knotting spindle 844. Where the knotting spindle 844 forms a circle in cross-section, the flange can extend and form a "C". Additionally, the flange 845 can be formed from one or more sections. The flange 845 can have a shaped surface 850 along a surface perpendicular to the face 846 wherein the shaped surface 850 is configured to conform to a device retainer 600, as shown also in FIG. 6. In the configuration shown in FIGS. 8A-1-8F, the medical device 110 fits within the device retainer 600, such that the medical device 110 sits on a surface of the barrel 620 and the device holder 622 sits on top of the medical device 110. A control pin 630 can be provided to engage the barrel 620 with the device holder 622. Additionally, one or more position stabilizing pins 632, 634 can be provided to engage the barrel 620 with the device holder 622 from a perpendicular position to the control pin 630. The device holder 622 can have a device holder aperture 623 which receives a device holder pin 625. Once the device is positioned within the device retainer 600, the device retainer 600 travels from a position exterior to the outer surface of the winding mandrel 842 towards the center of the winding mandrel 842 until the device retainer 600 engages the locking tab aperture 849 of the locking tab 848. The device retainer 600 can be positioned along the shaped surface 850 of the flange 845 on a first surface. A mating element 851 can be provided to secure the device retainer 600 securely against the shaped surface 850 of the flange 845.

Figure 8D:
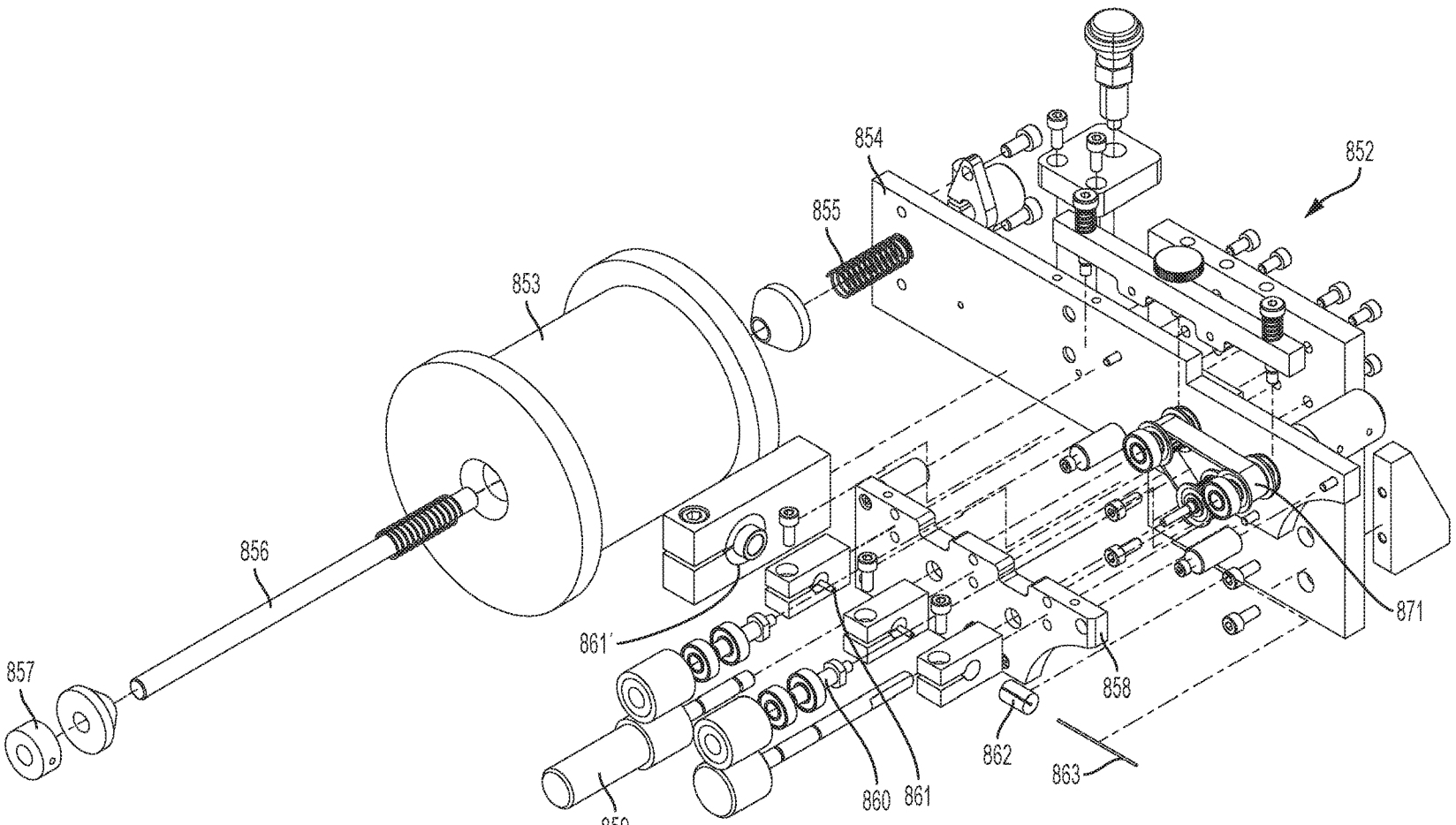
FIG. 8D is an exploded view of a feed in assembly.

FIG. 8D is an exploded view of a feed in assembly 852 which is part of the threader/spooler area 840 shown in FIG. 8A-2. The feed in assembly 852 has a suture spool 853 which engages a feed assembly plate 854 utilizing one or more compression springs 855 which surround a suture spool spindle 856 that passes through the central lumen in the suture spool 853. A spindle securement 857 engages the suture spool 853, or spindle, to ensure that the suture spool 853 remains in tensioned engagement with the feed assembly plate 854. A roller plate 858 is provided adjacent the suture spool 853 parallel to the feed assembly plate 854. The roller plate 858 has a plurality of shafts 859 in engagement with its surface. Ceramic tube guides 861, 861' are provided to guide the suture and minimize wear. A sleeve 862 can be provided through which a hypodermic needle 863 passes. The sleeve 862 can be formed from any suitable material including, for example, polytetrafluoroethylene (PTFE). The hypodermic needle 863 can pass through a portion of the roller shafts 860. A drive belt 871 is provided. When the drive belt 871 is turned, the shafts 859 and roller shafts 860 turn.

Figure 8E:
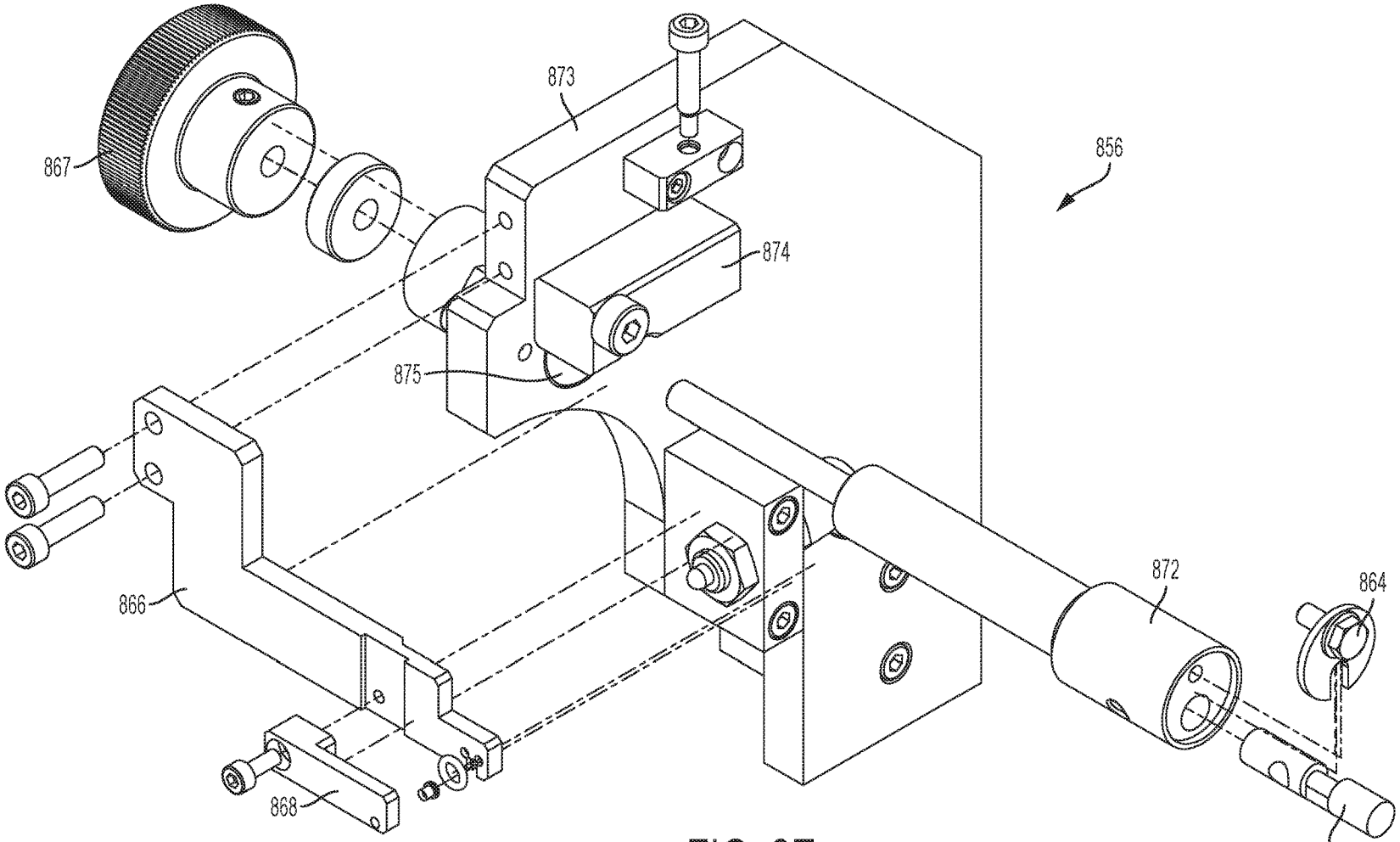
FIG. 8E is an exploded view of a suture guide and spindle.
Figure 8F:
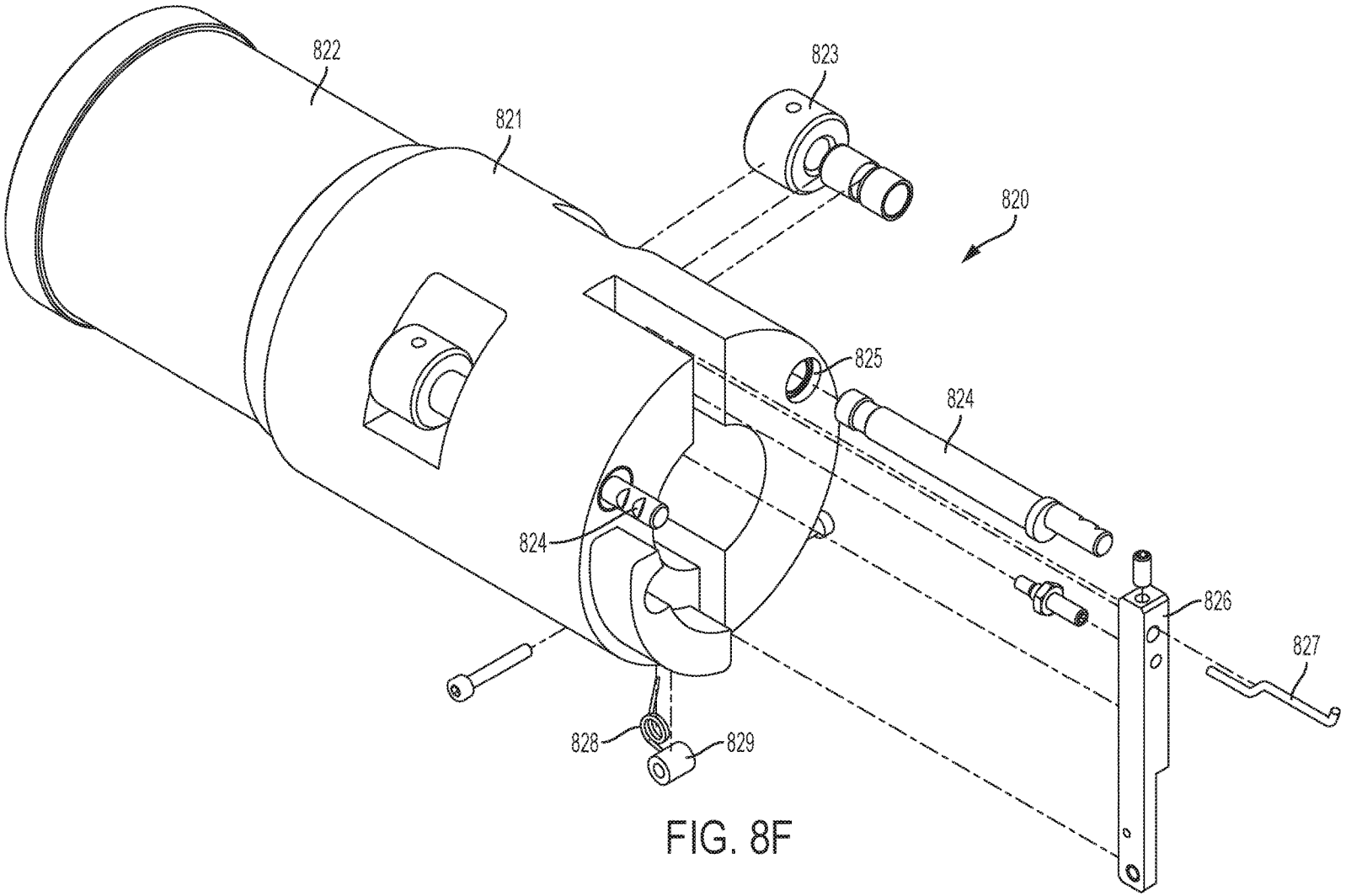
FIG. 8F is an exploded view of a suture wing tool.

FIG. 8E is an exploded view of a suture guide and spindle. The suture guide and spindle has a winding spindle 872 which engages a spooling housing 873. A spindle brake 874 is provided which controls the speed at which the winding spindle 872 rotates. A first end of the winding spindle 872 has a spindle washer 864 which engages a spindle trap pin 865. The opposing end of the winding spindle 872, after passing through a spooling housing aperture 875 in the spooling housing 873, engages a knob 867. A suture guide 868 is provided which engages the guide block 866.

FIG. 8F is an exploded view including a suture wing tool barrel 821 which engages a follower female barrel 822. An eccentric adjustor 823 fits within a portion of the suture wing tool barrel 821 and engages a tension eccentric 824 which slides through an off center aperture 825 in the suture wing tool barrel 821. A connector 826 engages a hook finger 827. The hook finger 827 can take a variety of forms as shown in FIGS. 9E-H. A torsion spring 828 and PTFE sleeve 829 can also be provided to maintain tension.

Figures 1, 9A:
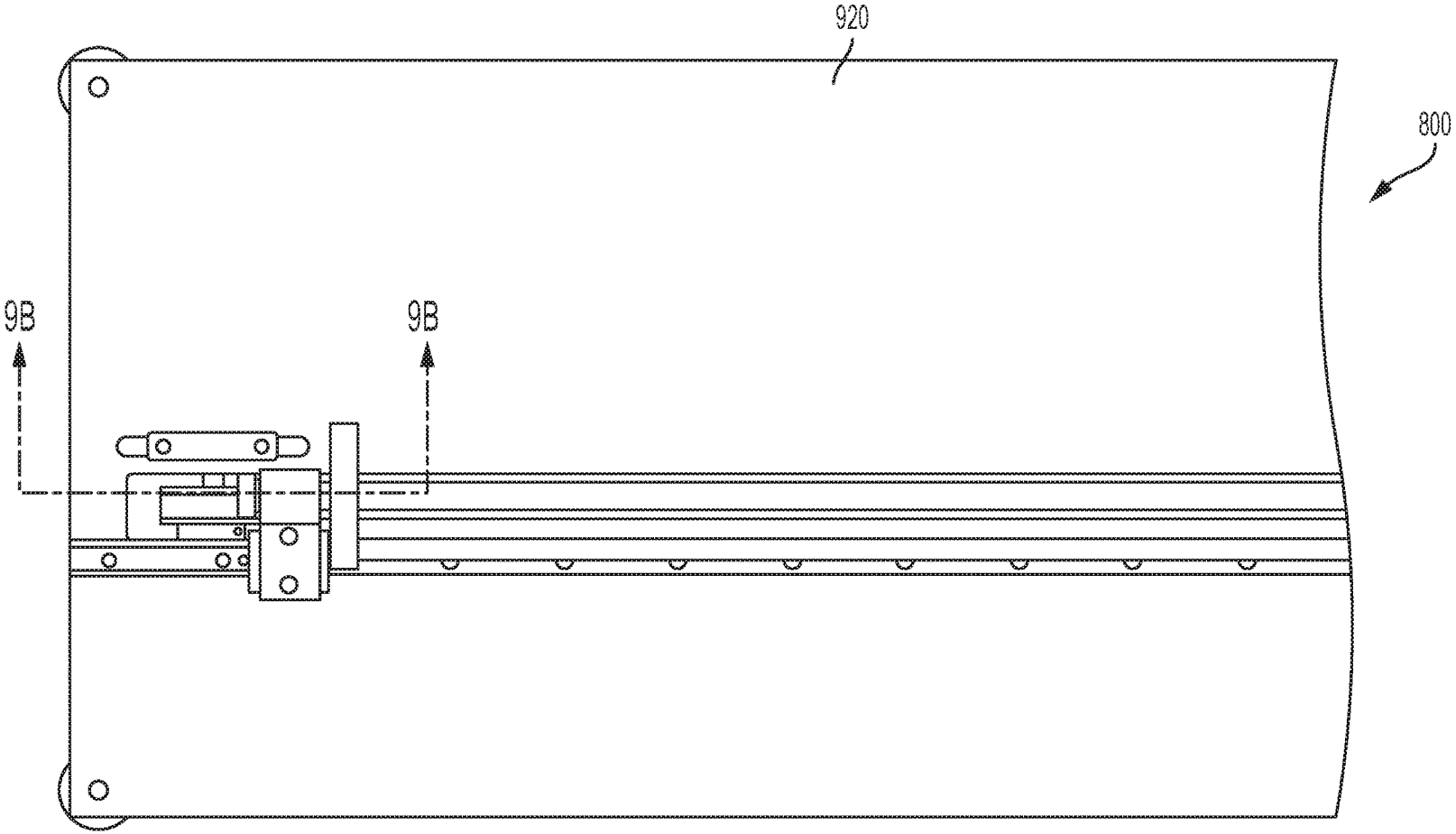
Figures 2, 9A:
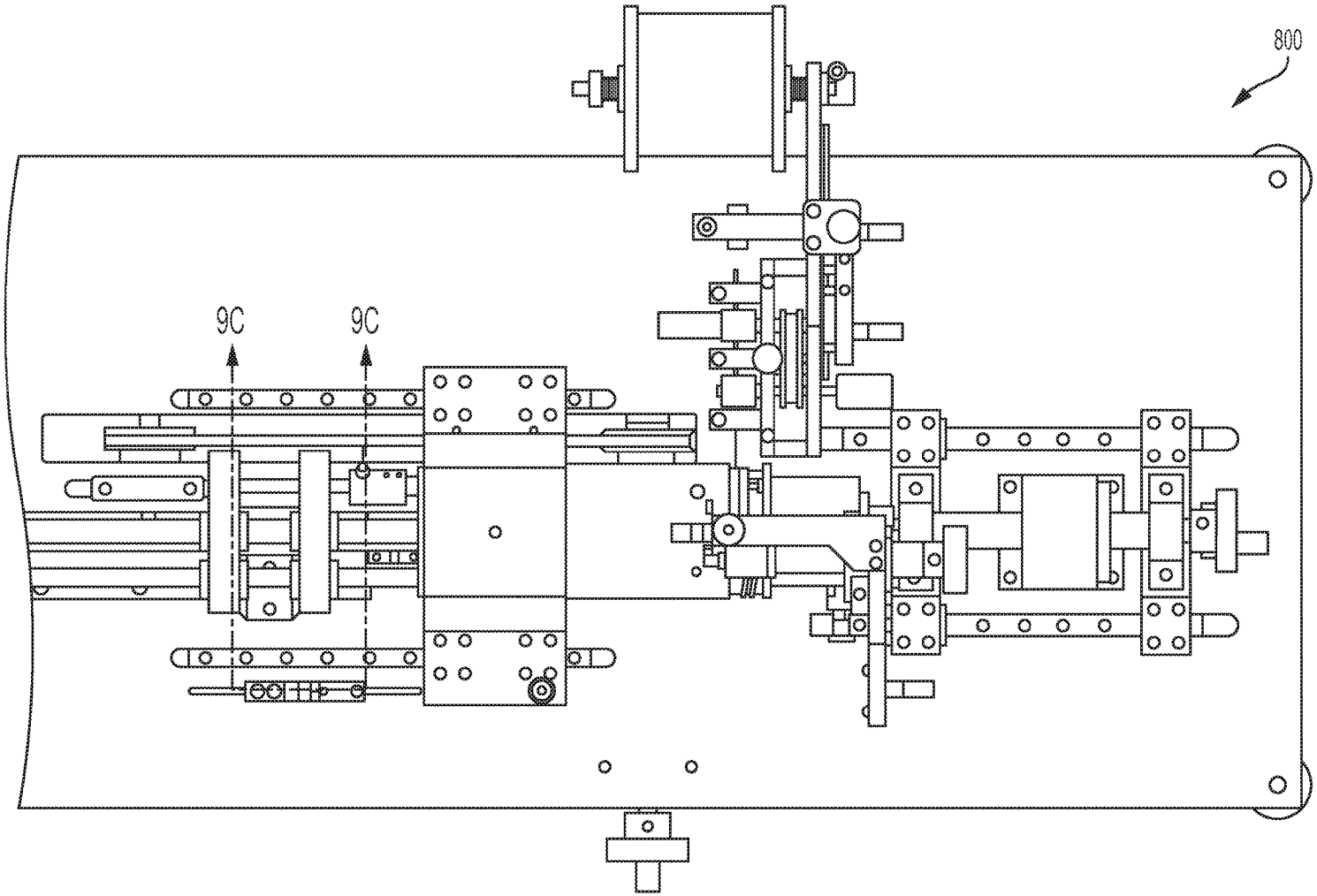
Figure 9C:
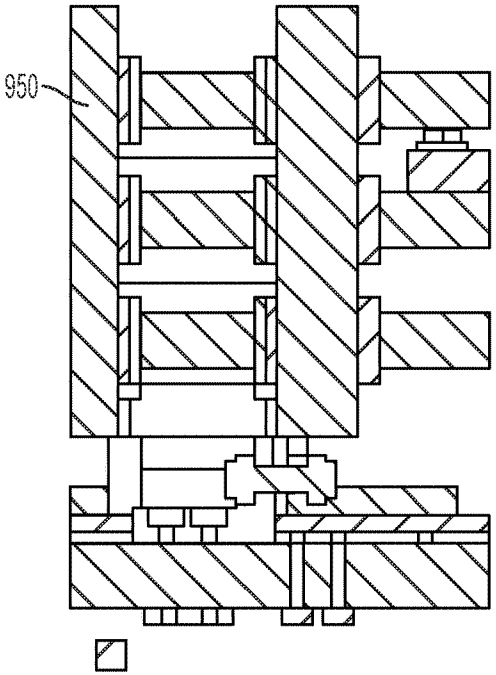
Figure 9B:
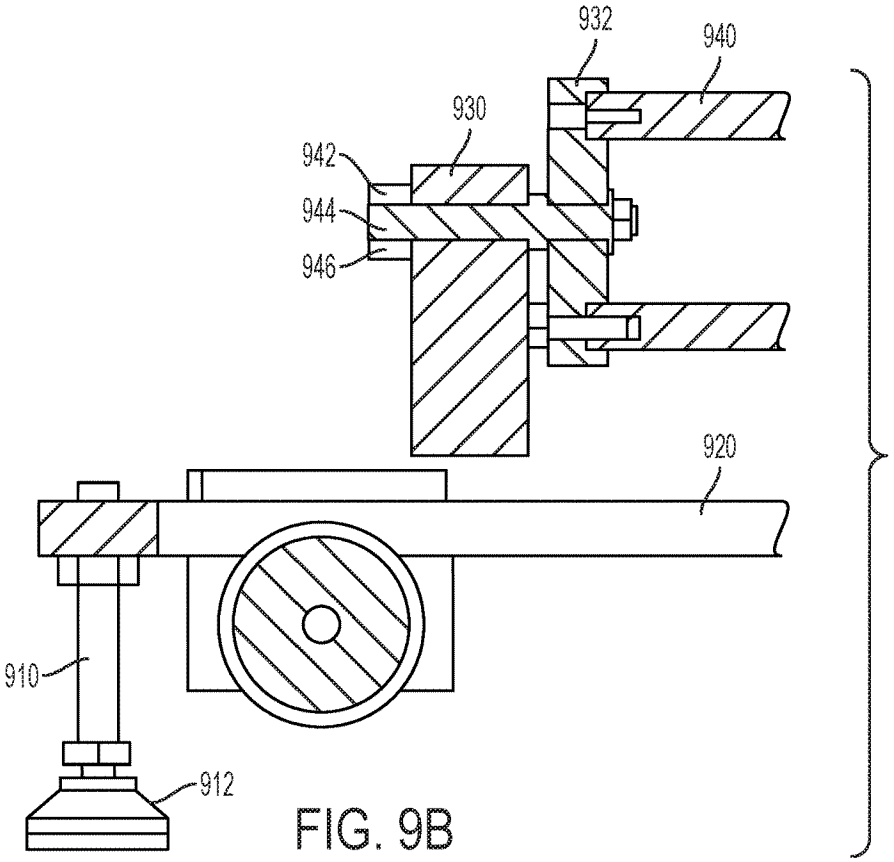
Figures 1, 9D:
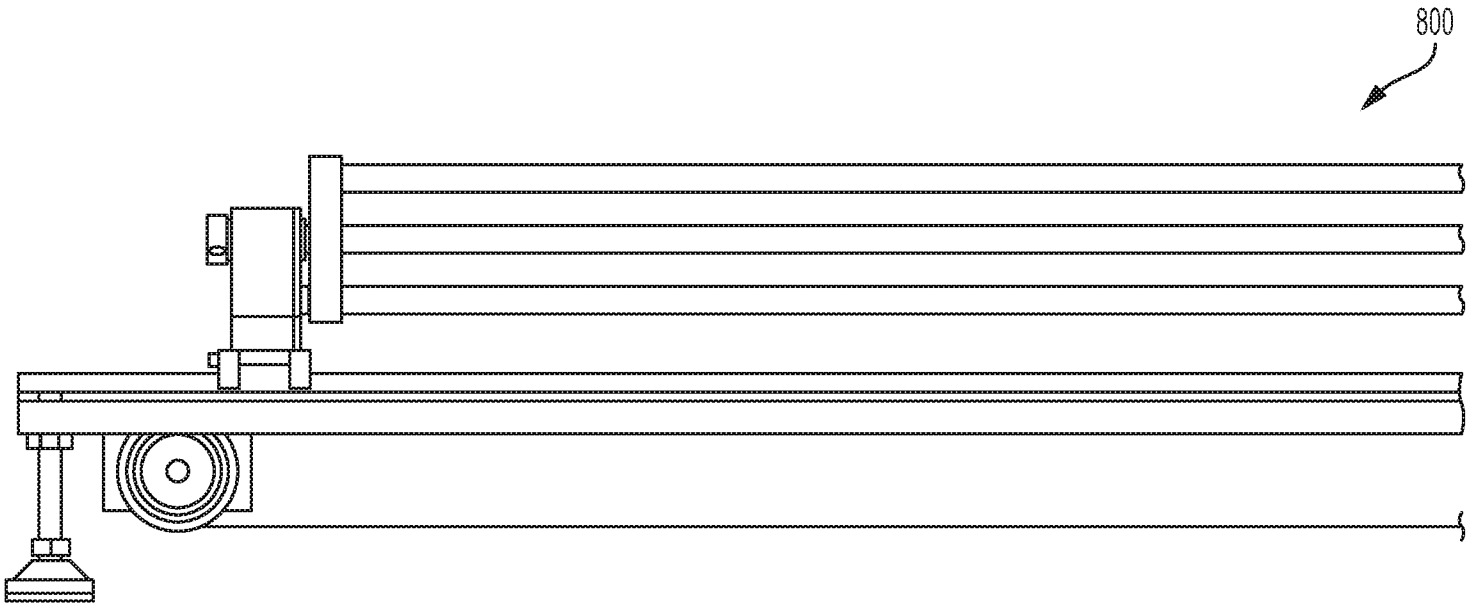
Figures 2, 9D:
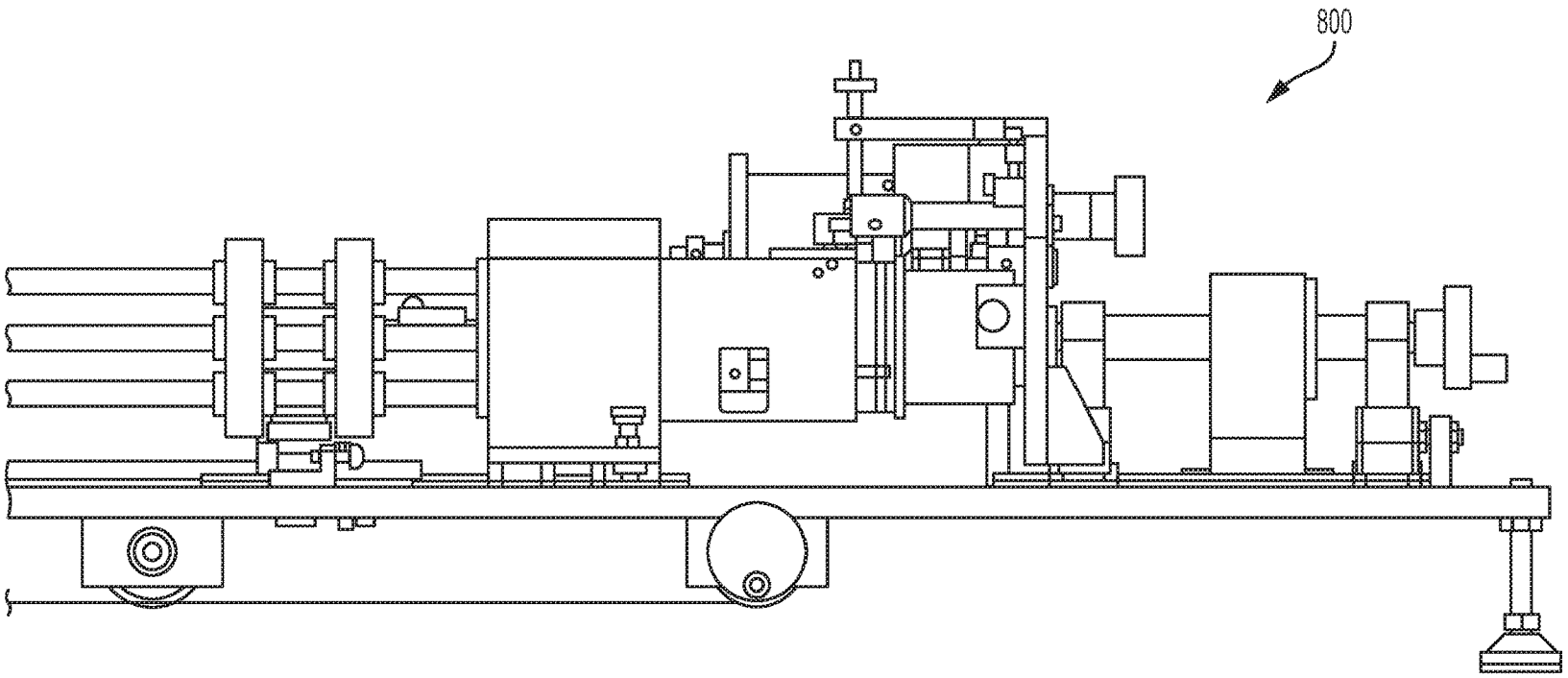
Figure 9E:
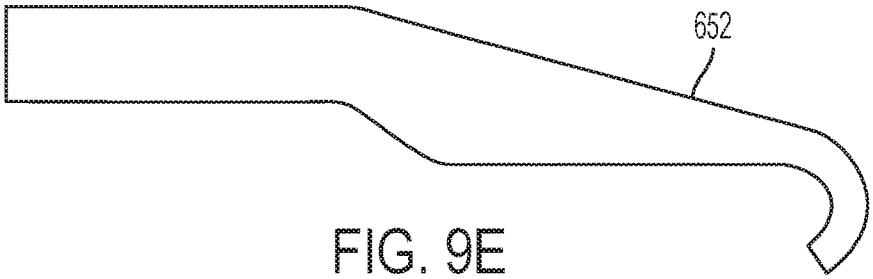
Figure 9F:
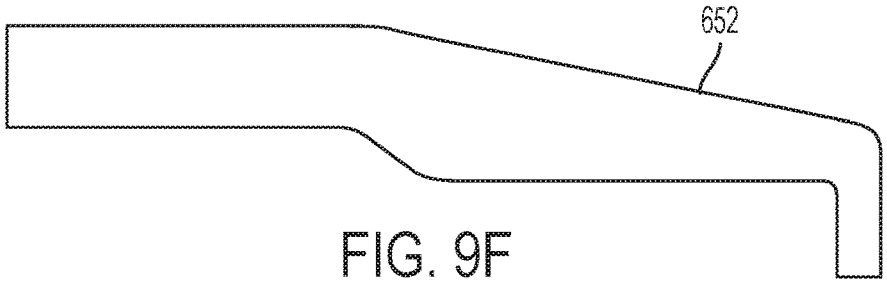
Figure 9G:
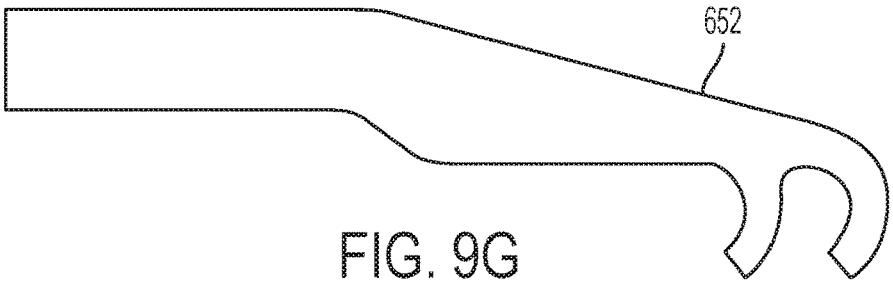
Figure 9H:
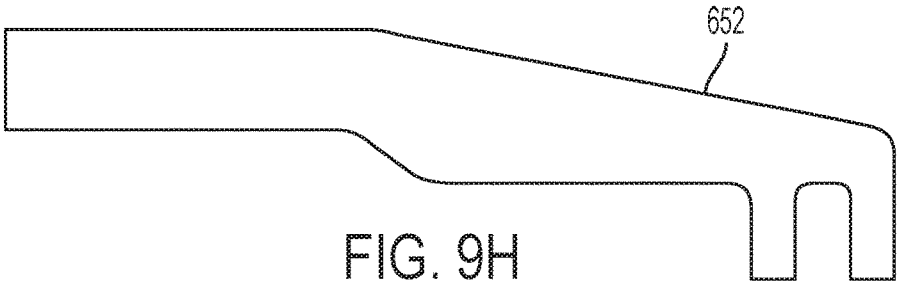
Figure 9I:
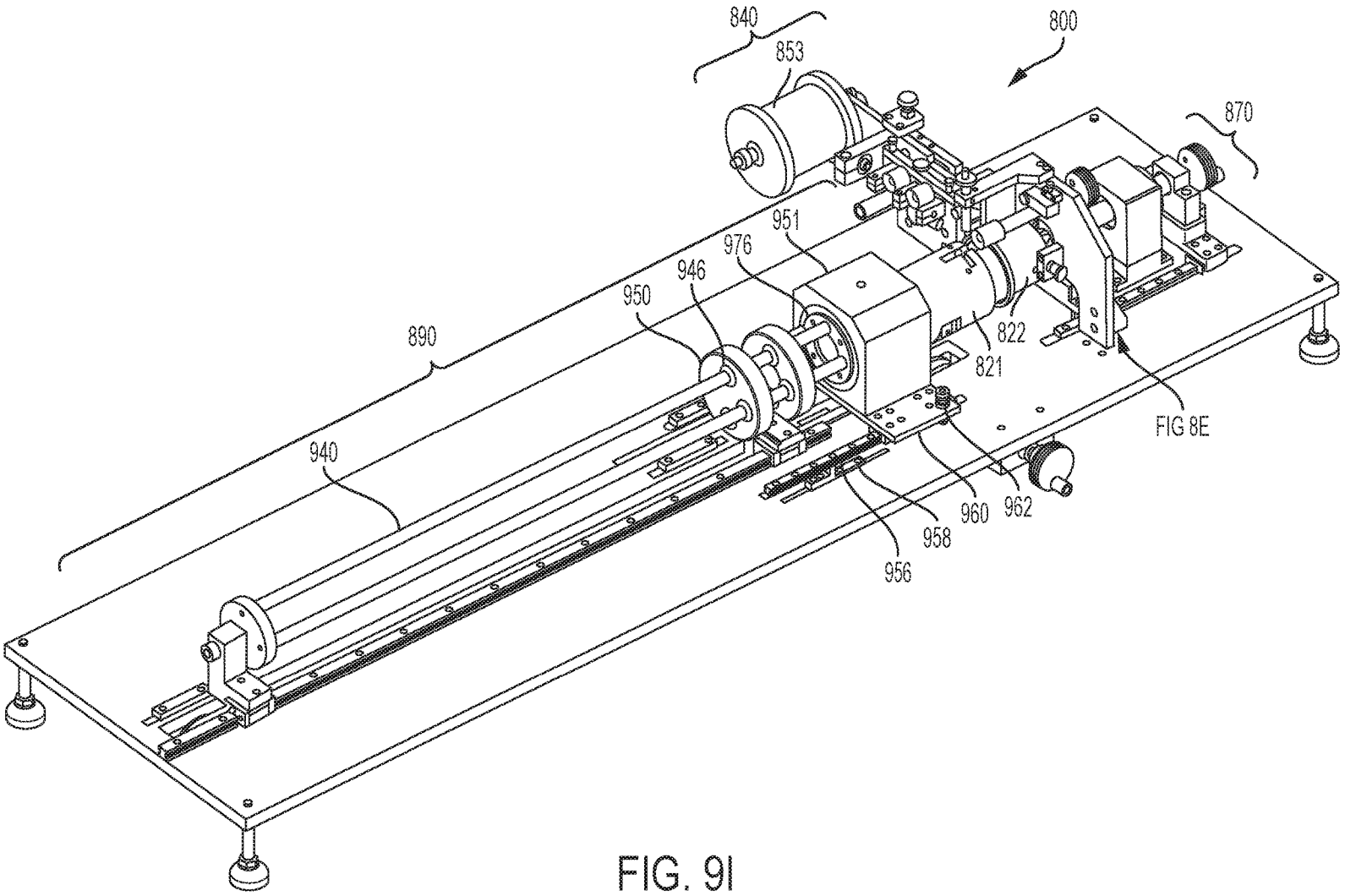
Figure 9J:
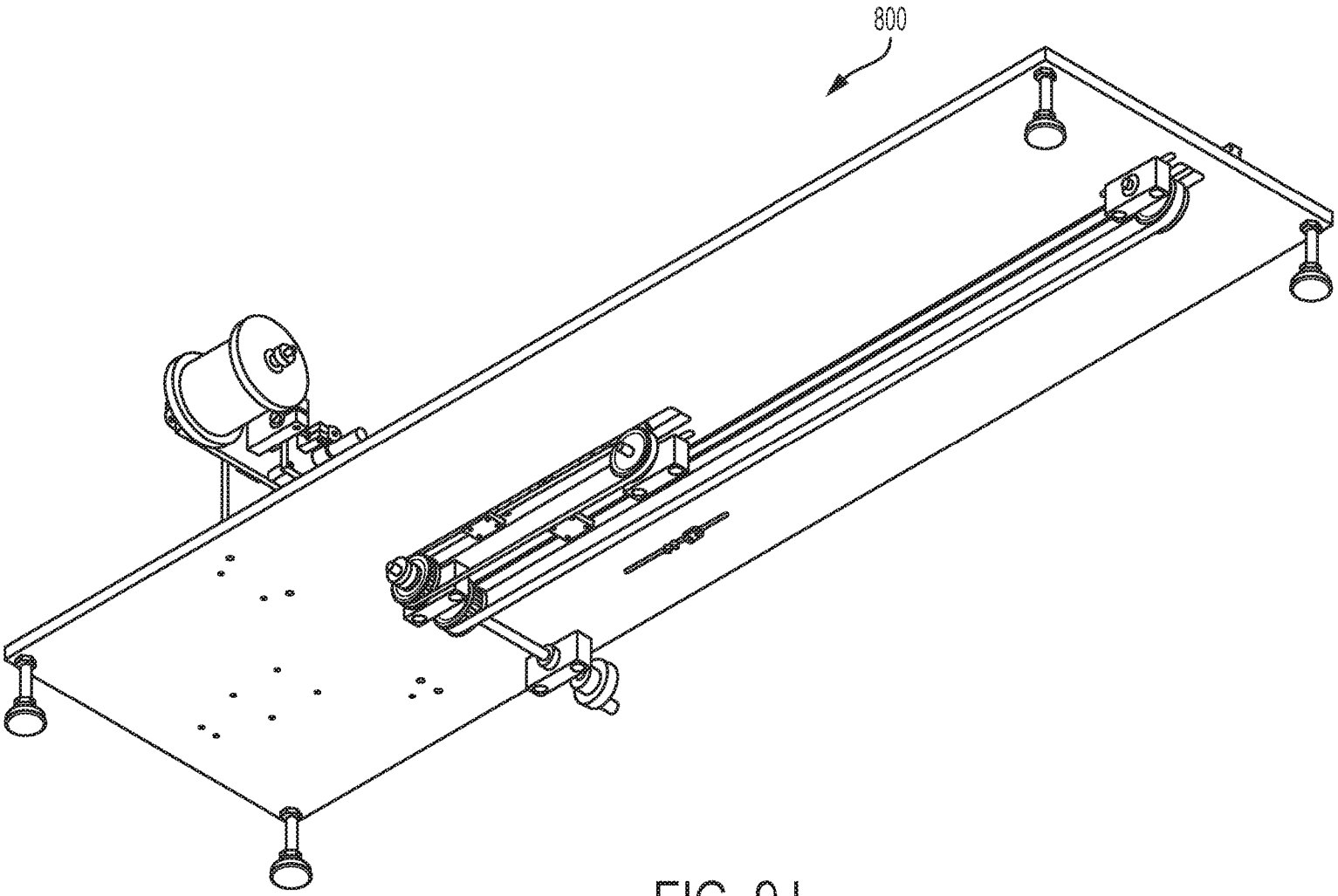

FIGS. 9A-1-9J illustrate the knot tying device 800 for forming a surgeon's knot. FIG. 9A-2 is a top view of the knot tying device 800 shown in FIG. 8A-1-8F. FIG. 9B is cross-section view of 9B-9B from FIGS. 9A-1. A leg 910 with a foot 912 supporting the platform 920. On the platform 920, or base, is a portion of the knot tightening apparatus area 890 from FIG. 8A-1-8F. An end carrier 930 engages the platform 920. The end carrier 930 engages an anchor disk 932 and a linear shaft 940. A shaft collar and set screw 942 secures a winding stub shaft 944 with a flanged bushing 946. FIG. 9C is a view of 9C-9C of FIG. 9A-2. FIG. 9C illustrates the rotary block 950. FIGS. 9D-1-9D-2 is a side view of the knot tying device 800. FIGS. 9E-H illustrate configurations of hook 652 which can be used in the knot tying device 800. The hook 652 can take a variety of configurations shown in profile as, for example, curved (FIG. 9E), perpendicular (FIG. 9F), double curved (FIG. 9G), and double perpendicular (FIG. 9H).

FIG. 9I is a perspective view of a knot tying device 800 of FIGS. 8A-1-8F with a loop formation component area 870, a threader/spooler area 840 component, a knot tightening apparatus area 890, and a suture wing tool barrel 821 which includes a device retainer which can be loaded into the system. The suture spool 853 provides a source for a flexible member. A follower block mount 951 engages the knot tightening apparatus area 890 and has a bearing clamp plate 976 on one side. The follower block mount 951 engages the rotary block 950. A flanged bushing 946 is provided through which a linear shaft 940 passes. The follower female barrel 822 is adjacent the suture wing tool barrel 821. A follower block mount plate 960 is provided between the platform 920 and the follower block mount 951. An indexing plunger 962 can be provided to secure the follower block mount plate 960 to the platform 920. A stopper 956 is provided in communication with a locator block 958. FIG. 9J shows the knot tying device 800 from a bottom surface.

Figure 10B:
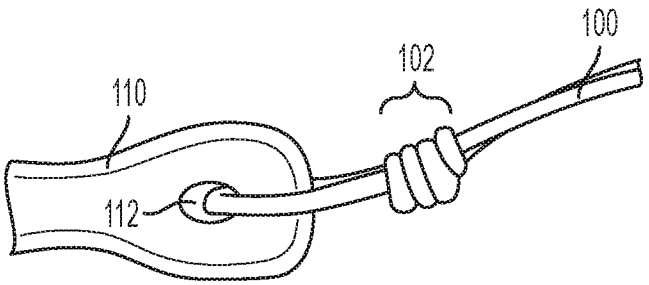
FIGS. 10A-C illustrate suitable knots formed by the device.
Figure 10A:
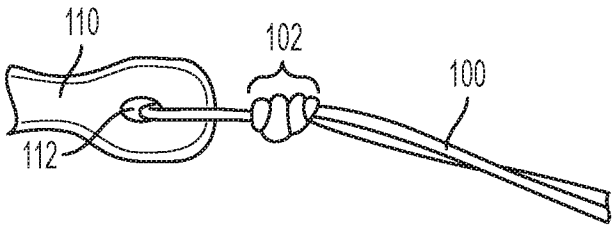
Figure 10C:
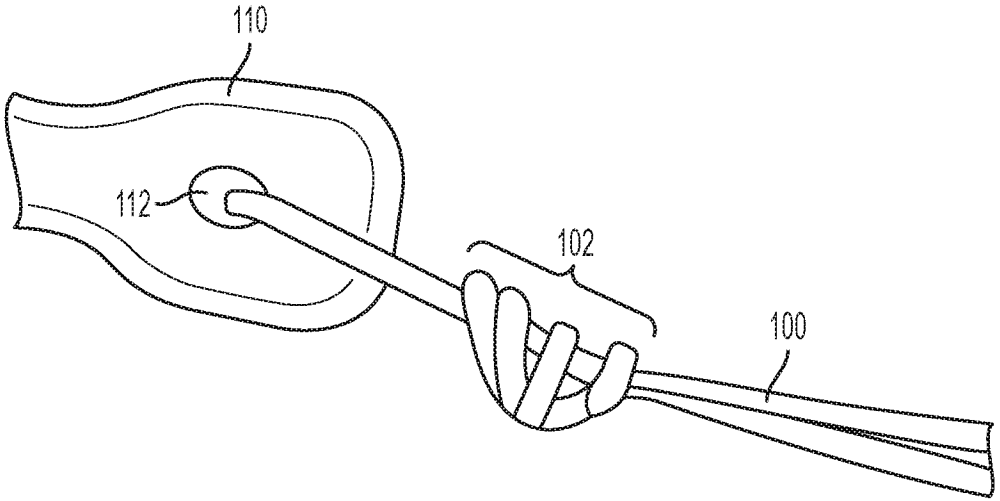

FIGS. 10A-C illustrates a plurality of surgeon's knots 102 in the flexible element 100 formed by the knot tying device 800 (FIGS. 8A-1-9J) which engage the eyelet 112 of the medical device 110. The distance between an end of the medical device 110 and the beginning of the surgeon's knot 102 is greater than 0.5 mm, the distance between the end of the medical device 110 and the end of the surgeon's knot 102 away from the end of the medical device 110 is 7 mm or less. The thickness of the surgeon's knot 102 at its thickest location is 1.5 mm or less.

When the medical device 110 has been knotted it is removed from the knot tying device 800 the flexible element 100 may be kinked due to the clamping mechanism used to hold the loose ends of the flexible element 100 in place during the knotting process. A length of flexible element 100 extends past where the flexible element 100 is clamped during the knotting process. The loose ends of the flexible element 100 may be released once the surgeon's knot 102 has been completed. Tension and/or heat can be applied to "stretch out" some of the coil memory from the spool.

In operation, when the device retainer (which holds the device) is lowered into a knotting position and the knotting components, the winding mandrel and knotting spindle, are moved together. The flexible element passes from the feed assembly into the eyelet of the medical device held by the barrel. The t-frame of the medical device can be held vertically within the tube (at a 90 degree angle from what is shown in FIG. 6). Once the knotting components are engaged, the device winds the flexible member onto the knotting spindle. This process transfers the flexible element from the winding spindle to the knotting spindle as the two spindles turn. Thereafter, the end of the flexible element is clamped and the ends of the flexible element are released. The spindle is then rotated to orient the medical device to vertical, a plunger and knotting pin are inserted and the knotting components are separated. As the knotting components are separated, the suture is pulled into a knot formation. A hook is positioned to engage the thread and to release as the knot is positioned optimally with respect to the end of the medical device. The plunger is lowered to the device head then the knotting pin is removed. The ends of the suture are released and the plunger is removed. The device retainer is positioned in line with the linear shaft.

The device is configurable to tie a double loop type surgeons' knot through an IUD device eyelet at a rate of 5 knots per minute, more preferably 7 knots per minute. In operation a knot is completed less than 12 mm away from the end of the IUD, more preferably less than 10 mm away from the end of the IUD, and even more preferably 7 mm away from the end of the IUD. Once tied, the resulting knot allows the IUD to move freely in any direction. The completed knot has an outer diameter less 2.0 mm, more preferably less than 1.75 mm, and even more preferably less than 1.5 mm. Typically more than 200 mm of thread extend beyond the knot on each loose end, more preferably more than 250 mm of thread extend beyond the knot and even more preferably 300 mm of thread extend beyond the knot on each loose end.

Use of the knot tying device, allows a surgeon's knot to be tied without an operator touching the suture during the knotting process. Additionally, the knot tying device can be manually loaded and unloaded. Additionally, the device is sized to fit on a bench or to be free standing, typically having a profile of 2 ft×5 ft×5 ft.

Figure 11B:
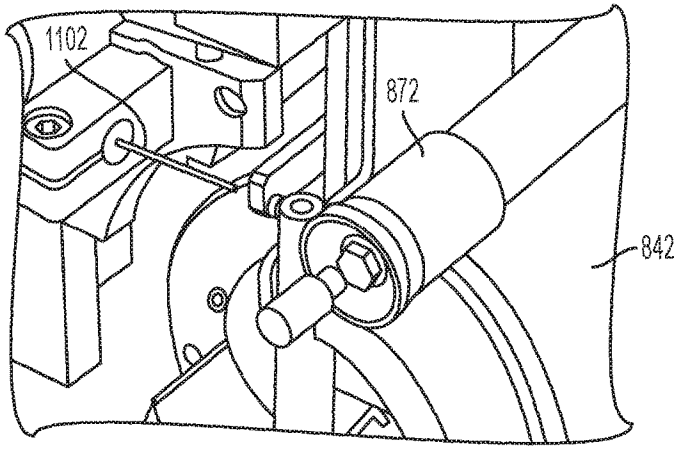
FIGS. 11A-Z illustrates the device at different steps in the process of forming a knot.
Figure 11A:
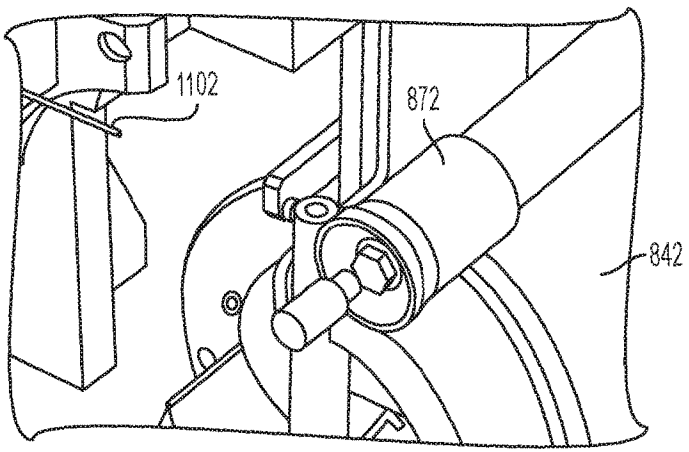
Figure 11D:
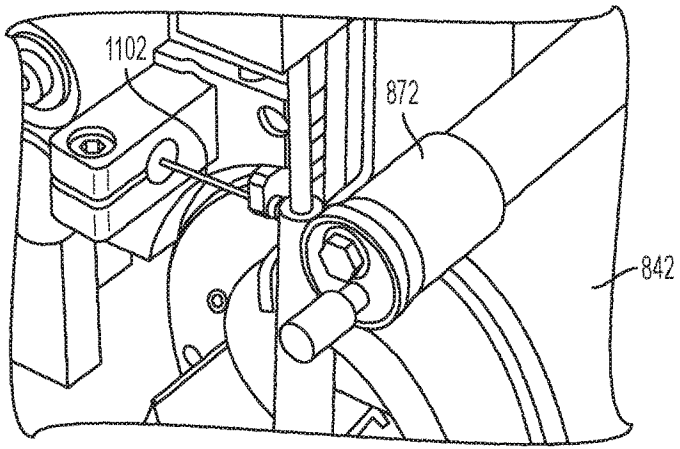
Figure 11C:
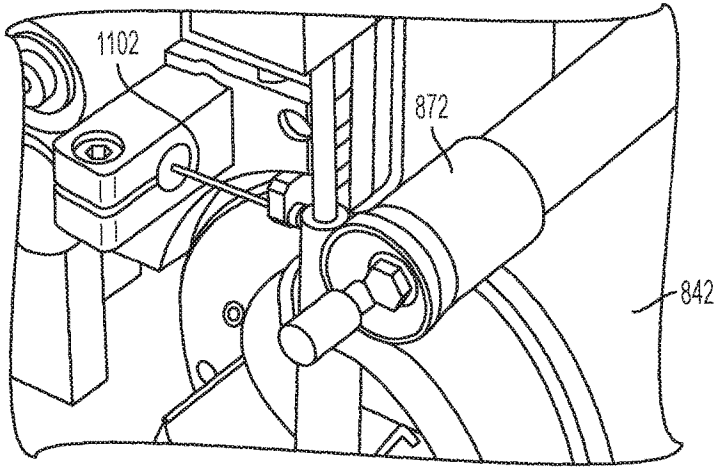
Figure 11F:
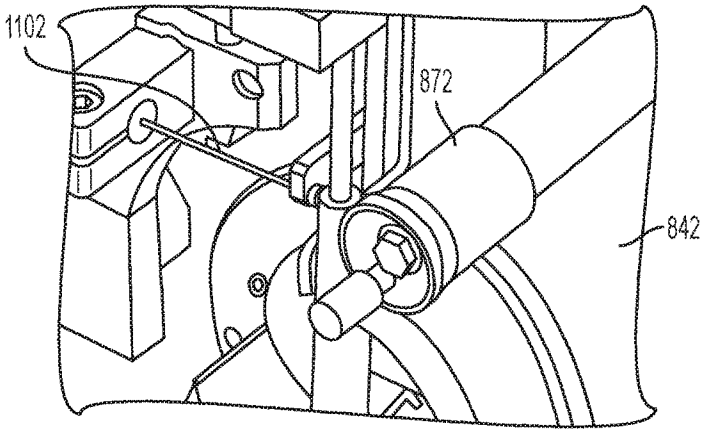
Figure 11E:
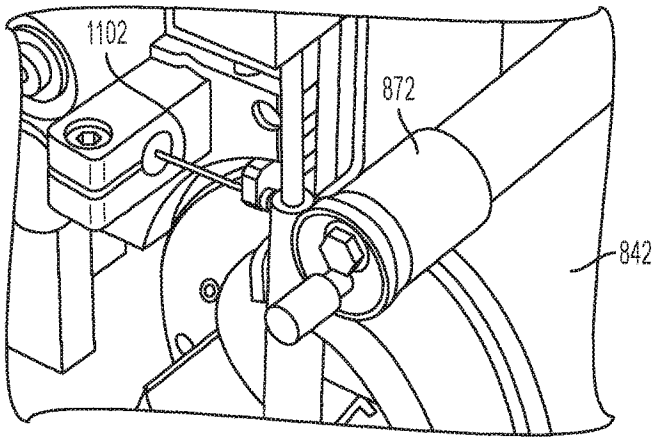
Figure 11H:
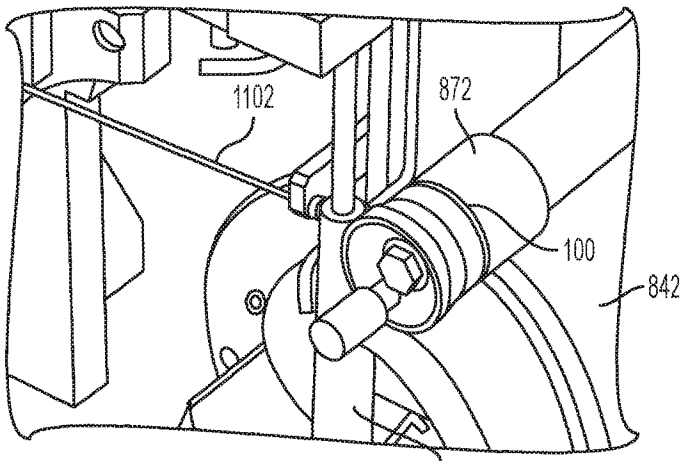
Figure 11G:
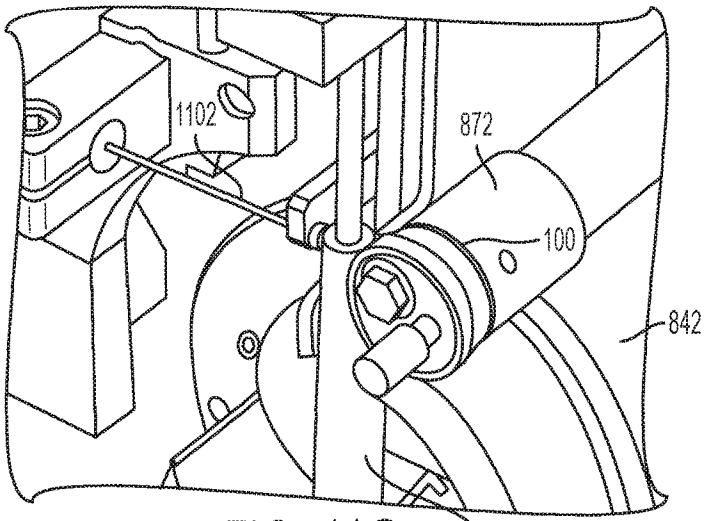
Figure 11J:
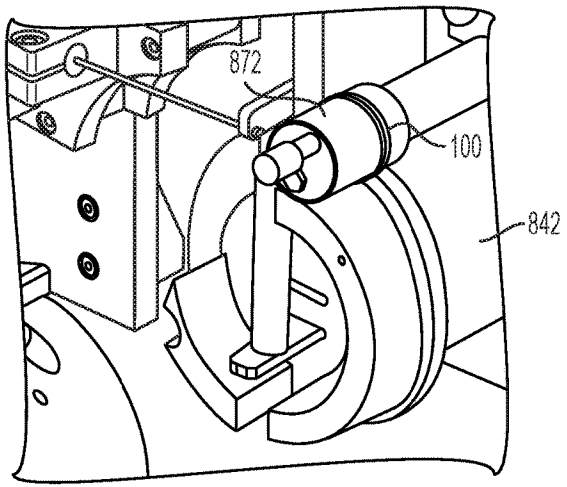
Figure 11L:
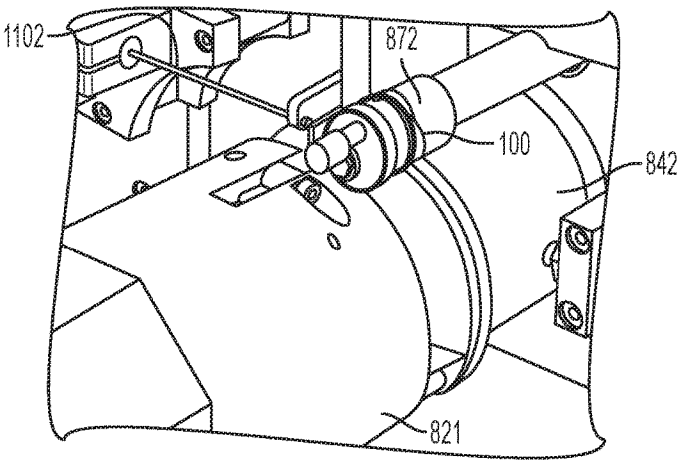
Figure 11I:
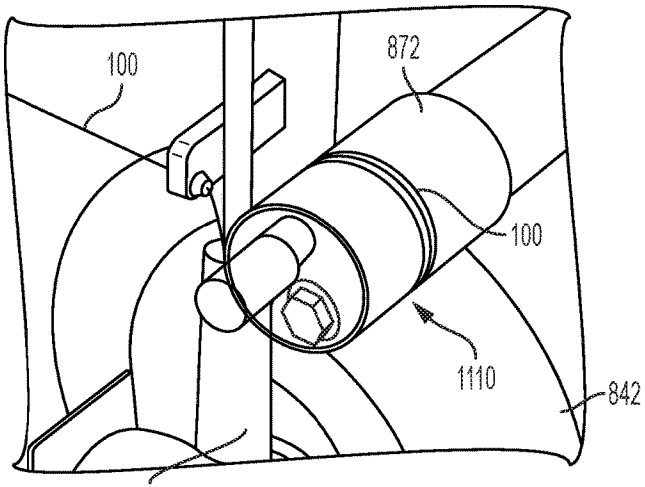
Figure 11K:
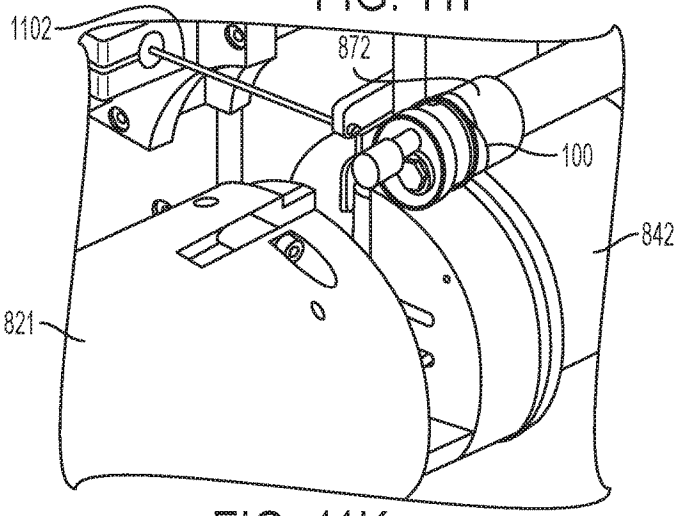
Figure 11N:
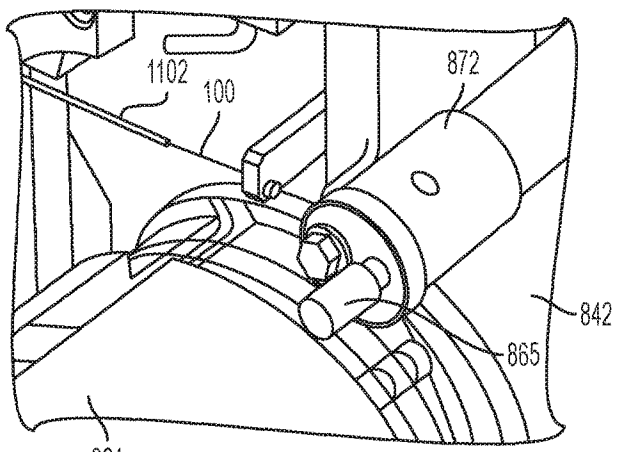
Figure 11P:
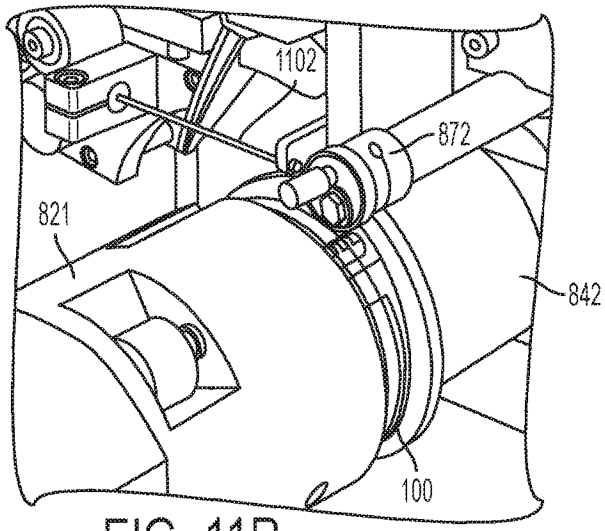
Figure 11M:
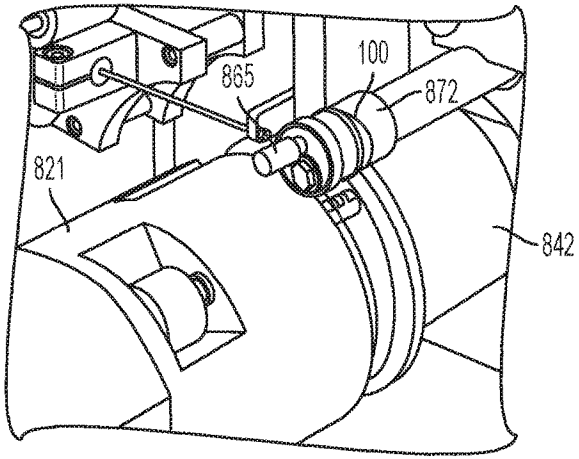
Figure 11O:
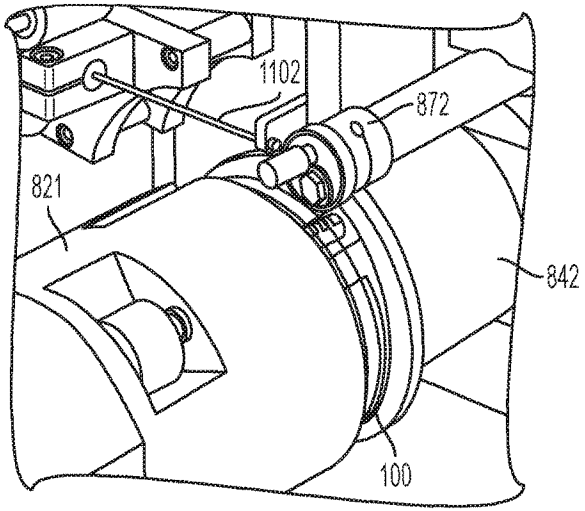
Figure 11R:
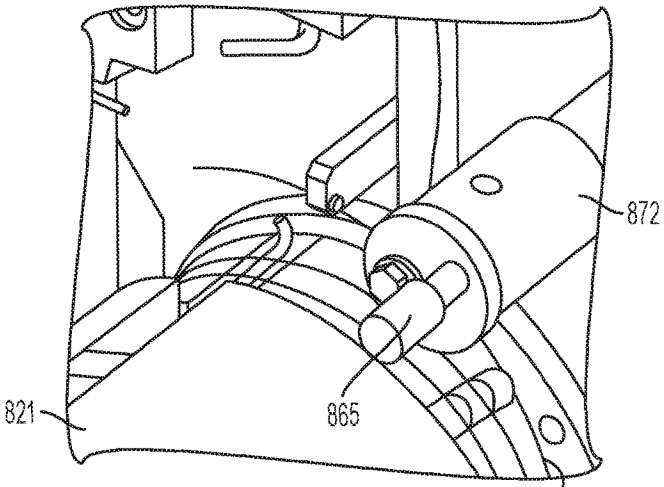
Figure 11T:
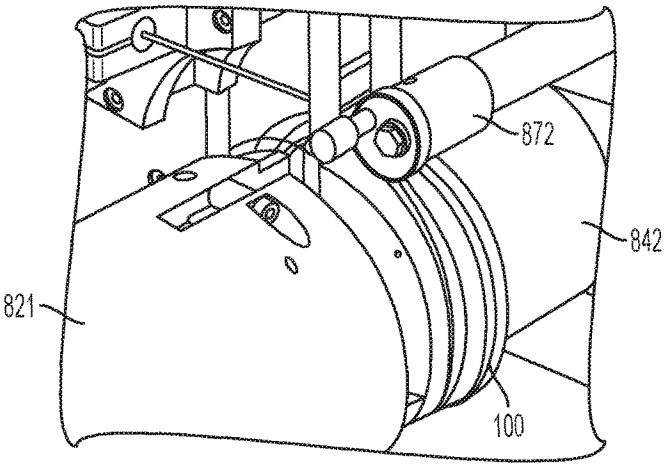
Figure 11Q:
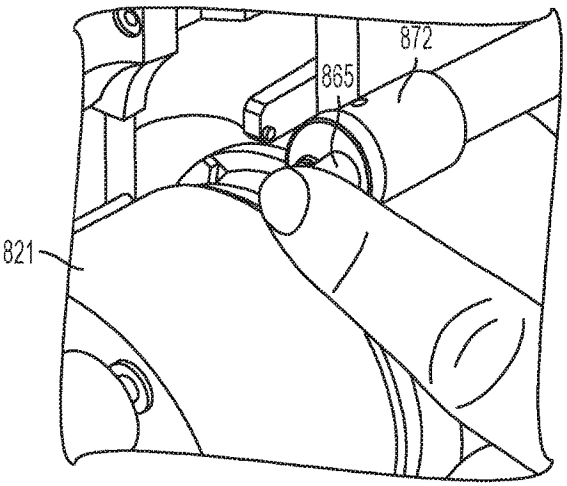
Figure 11S:
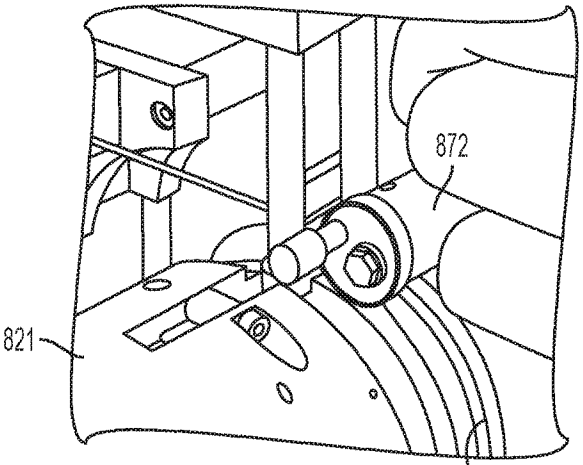
Figure 11V:
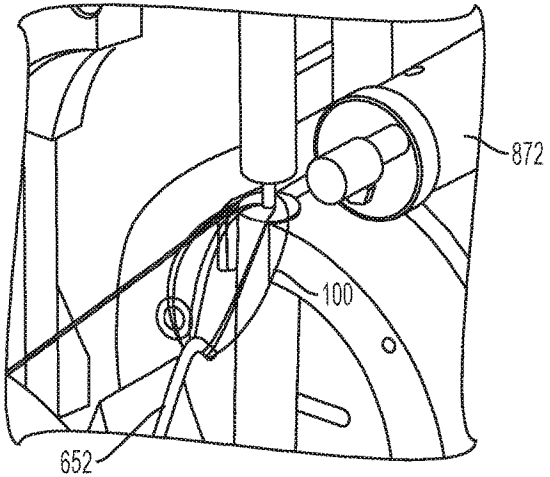
Figure 11X:
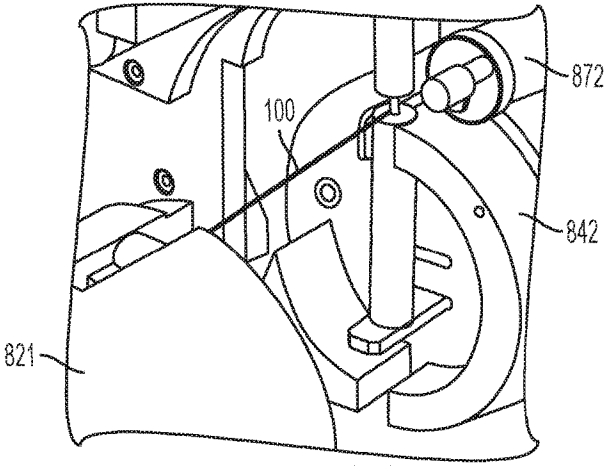
Figure 11U:
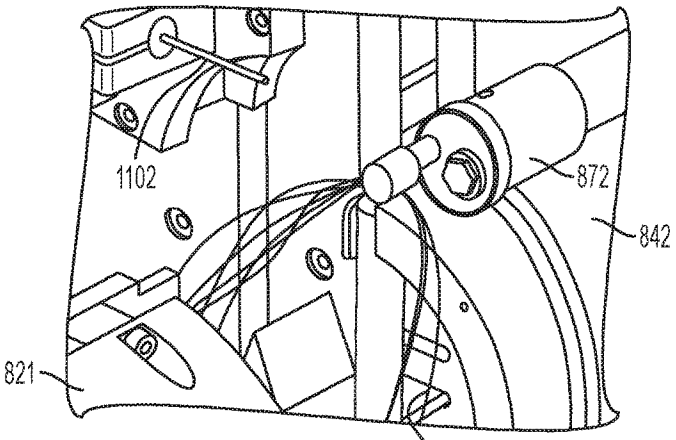
Figure 11W:
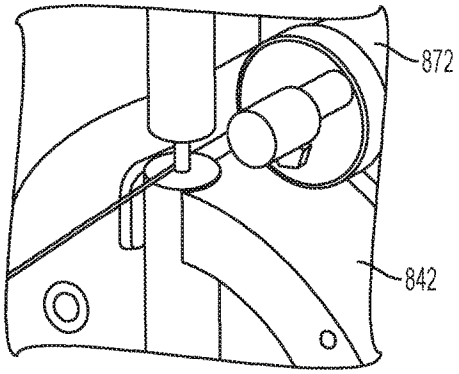
Figure 11Z:
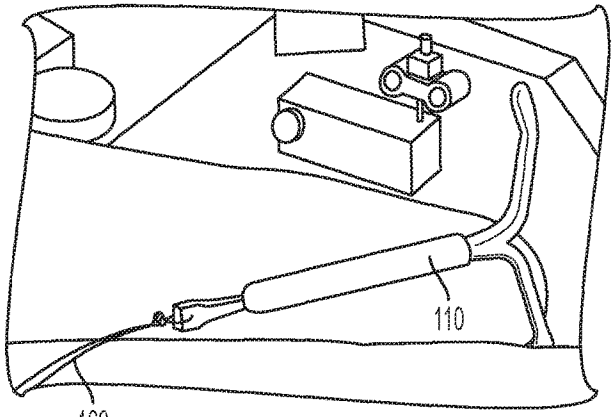
Figure 11Y:
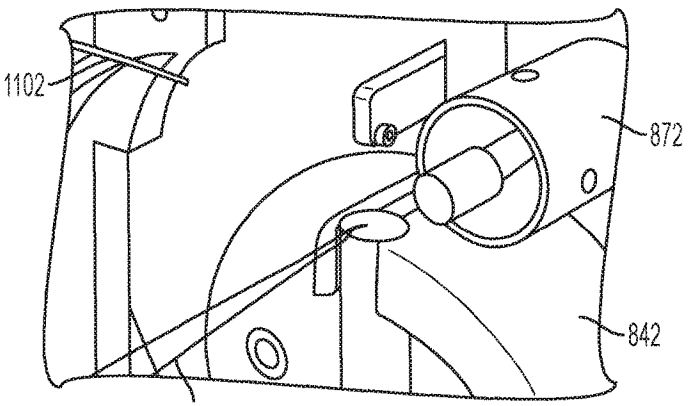

Turning to FIGS. 11A-Z, operation of the knot tying device 800 is illustrated at different steps in the process of forming a surgeon's knot 102 from a flexible element 100 with a focus on the area around the winding mandrel 842 and the winding spindle 872. Initially, a needle 1102 for feeding the flexible element 100 is moved into position (FIGS. 11A-B). Then the device head restrainer is put into position (FIG. 11C). The flexible element 100 is wound through the winding mandrel 842 (FIG. 11D) and then pressure on the nip feed 1110 area is released 11E. The flexible element 100 is wound onto the winding mandrel 842 (FIG. 11G), and then the device retainer 600 is lowered to a knotting position (FIG. 11H-I). The knotting components are then moved together at which point the flexible element 100 is wound onto the knotting spindle 844 (FIGS. 11J-L). The knotting spindle 844 turns clockwise while the flexible element 100 is wound around the knotting spindle 844 (FIGS. 11M-N), and then the end of the flexible element 100 is clamped (FIG. 11O) at which point the end of the flexible element 100 is released (FIG. 11P-Q). As the plunger 1112 is moved inward (FIG. 11R) the knotting spindle 844 rotates clockwise, when the plunger 1112 moves outward (FIG. 11S) the knotting spindle 844 rotates counterclockwise. The plunger 1112 is inserted (FIG. 11T) and the knotting components are separated (FIG. 11U). As the knotting components separate, the flexible element 100 engages a hook 652 which facilitates creation of a surgeon's knot as the two knotting components move away from each other (FIGS. 11V-X). The plunger 1112 is lowered and the knotting pin is removed (FIG. 11Y). The final position of the knot 102 is adjacent the medical device 110 (FIG. 11Z). As will be appreciated by those skilled in the art, the steps engaged by the device can be manual, semi-automatic or fully automatic. Where the device is semi-automatic or fully automatic, a suitable power supply is provided. Additional components such as computing systems, controllers, drivers, and the like can be provided.

The systems and methods described herein may rely on a variety of computer systems, networks and/or digital devices for operation. As will be appreciated by those skilled in the art, a computer readable medium can be employed that stores computer data, which data can include computer program code that is executable by a computer, in machine readable form. By way of example, and not limitation, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable storage media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

Some embodiments may be implemented in one or a combination of hardware, firmware and software. Embodiments may also be implemented as instructions stored on a non-transitory computer-readable storage medium, which may be read and executed by at least one processor to perform the operations described herein. A non-transitory computer-readable storage medium may include any mechanism for storing information in a form readable by a machine (e.g., a computer). For example, a non-transitory computer-readable storage medium may include read-only memory (ROM), random-access memory (RAM), magnetic disk storage media, optical storage media, flash-memory devices, and other non-transitory media.

Figure 12:
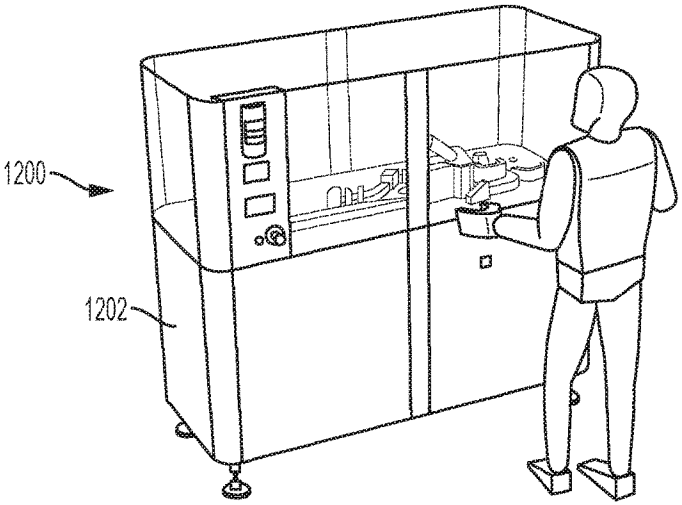
FIG. 12 illustrates a machine having the knot-tying device.

FIG. 12 illustrates a machine 1200 having the knot-tying device incorporated into a housing. The housing 1202 can, for example, be used to maintain a sterile environment during the knotting process.

Figure 13:
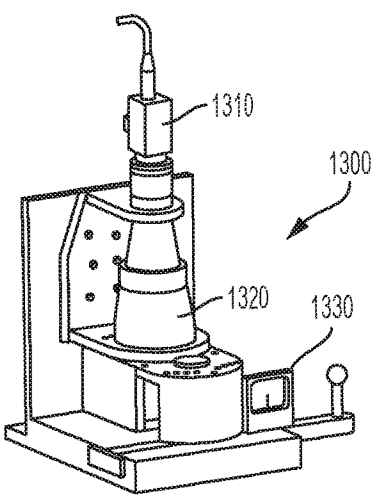
FIG. 13 illustrates an optical automated quality inspect component which can be integrated into the machine of FIG. 12.

FIG. 13 illustrates an optical automated quality inspection component 1300 which can be integrated into the housing containing the knotting device of FIG. 12. The optical automated quality inspection component 1300 can have a camera 1310, a cage 1320 and a loader 1330 which accepts one device at a time after the knotting process. The quality inspection system takes a picture of the IUD with the flexible member knotted thereon and determines if the knot is positioned within a determined distance from the IUD and has a knot thickness within a determined range. If the knot is within range, the knotted IUD is passed to a QC passed vessel, if the knot is not within range, then the knotted IUD is passed to a QC fail vessel.

As will be appreciated by those skilled in the art a plurality of washers, screws (such as socket head cap screws), plungers, clamps, bolts, nuts, brackets, pulleys, panels, and the like can be used in an embodiment of the disclosed apparatuses, devices and systems without departing from the scope of the disclosure.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An apparatus for forming a knot in a flexible element which has been threaded through an aperture of a medical device comprising:

a loading element for receiving the medical device;

a spooling element for threading the flexible member through the aperture of the medical device wherein the spooling element further comprises a spool spindle, a nip feed and a thread spool and automatically engages the loading element;

a looping element for looping the flexible member wherein the looping element automatically engages when the flexible member is threaded through the aperture of the medical device;

a knot tightening element for tightening the looped flexible member to form the knot wherein the knot tightening element automatically engages after the looping element loops the flexible member; and a base wherein the loading element, spooling element and looping element are positioned on an upper surface of the base.

2. The apparatus of claim 1 wherein the loading element further comprises a platform for engaging the medical device wherein the platform for engaging the medical device integrally forms with a barrel having a central barrel aperture.

3. The apparatus of claim 1 wherein the looping element further comprises a winding mandrel.

4. The apparatus of claim 1 wherein the knot tightening element further comprises a rotary lock and a shaft.

5. The apparatus of claim 1 further comprising a housing wherein the loading element, spooling element, looping element, knot tying element and base are positioned within the housing.

6. The apparatus of claim 5 wherein the apparatus is connected to a vision inspection device.

7. The apparatus of claim 6 wherein the vision inspection device includes a camera and a medical device loader.

8. A method of forming a knot in a medical device comprising:

loading the medical device into a knotting device wherein the knotting device has a loading element, a spooling element, a looping element, a knot tightening element, and a base;

passing a flexible element through an aperture in the medical device while the medical device engages the spooling element wherein the spooling element further comprises a spool spindle, a nip feed and a thread spool;

winding a length of the flexible element about the spool spindle of the spooling element;

releasing a first end and a second end of the flexible element;

moving the loading element away from the looping element;

engaging a portion of the wound flexible element with a hook;

applying a tension on the flexible element; and releasing the hook as the knot forms in the flexible element adjacent the medical device, wherein the method is performed automatically or semi-automatically.

9. The method of forming the knot in a medical device of claim 8 further comprising obtaining an image of the formed knot.

10. The method of forming the knot in a medical device of claim 9 further comprising analyzing the image of the formed knot to determine a dimension and a location of the knot.

11. The method of forming the knot in a medical device of claim 10 further comprising approving the medical device with the knotted flexible member if the analyzed dimensions detected from the image of the knot formed are within a dimension range for the knot size and location.

12. An apparatus for forming a knot in a flexible element which has been threaded through an aperture of a medical device comprising:

a loading element means for receiving the medical device;

a spooling element means for threading the flexible member through the aperture of the medical device wherein the spooling element means further comprises a spool spindle, a nip feed and a thread spool and automatically engages the loading element means;

a looping element means for looping the flexible member wherein the looping element means automatically engages when the flexible member is threaded through the aperture of the medical device;

a knot tightening element means for tightening the looped flexible member to form the knot wherein the knot tightening element automatically engages after the looping element means loops the flexible member; and a base wherein the loading element means, spooling element means and looping element means are positioned on an upper surface of the base.

13. The apparatus of claim 12 wherein the loading element means further comprises a platform for engaging the medical device wherein the platform for engaging the medical device integrally forms with a barrel having a central barrel aperture.

14. The apparatus of claim 12 wherein the looping element means further comprises a winding mandrel.

15. The apparatus of claim 12 wherein the knot tightening element means further comprises a rotary lock and a shaft.

16. The apparatus of claim 12 further comprising a housing wherein the loading element means, spooling element means, looping element means, knot tying element means and base are positioned within the housing.

17. The apparatus of claim 16 wherein the apparatus is connected to a vision inspection device means.

18. The apparatus of claim 17 wherein the vision inspection device means includes a camera and a medical device loader.

* * * * *